US009758276B2

(12) United States Patent
Doggett et al.

(10) Patent No.: US 9,758,276 B2
(45) Date of Patent: Sep. 12, 2017

(54) METHOD AND APPARATUS FOR ULTRA-CLEAN SEEKER TRANSPORTATION AND STORAGE

(71) Applicant: RAYTHEON COMPANY, Waltham, MA (US)

(72) Inventors: Richard A. Doggett, Lubbock, TX (US); Eric P. Huelsmann, Tuscon, AZ (US); Julie L. Stasiak, Sahuarita, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 14/862,524

(22) Filed: Sep. 23, 2015

(65) Prior Publication Data

US 2017/0081846 A1 Mar. 23, 2017

(51) Int. Cl.

| | |
|---|---|
| ***B65D 19/00*** | (2006.01) |
| ***B65D 43/16*** | (2006.01) |
| ***B65D 25/28*** | (2006.01) |
| ***B65D 25/10*** | (2006.01) |
| ***B65D 19/42*** | (2006.01) |

(52) U.S. Cl.

CPC ..... *B65D 19/0002* (2013.01); *B65D 19/42* (2013.01); *B65D 25/10* (2013.01); *B65D 25/28* (2013.01); *B65D 43/16* (2013.01)

(58) Field of Classification Search

CPC .... B65D 25/10; B65D 43/16; B65D 19/0002; B65D 19/42; B65D 19/44; B65D 25/103; B65D 25/28; B65G 1/0492; B65G 1/0428

USPC ..... 206/723, 722, 1.5, 386, 595, 596, 598, 206/461, 470; 410/66, 67; 414/940

See application file for complete search history.

(56) References Cited

U.S. PATENT DOCUMENTS 3,181,541 A * 5/1965 Brooking ..... C23G 3/00 134/186

3,623,620 A 11/1971 Vermette (Continued)

FOREIGN PATENT DOCUMENTS

CN 201486387 U 5/2010

OTHER PUBLICATIONS

Wafer Handling Systems; http://wafercare.com/A; Entegris; printed Dec. 22, 2015; 1 page.

(Continued)

*Primary Examiner* — Theodore Adamos

(57) ABSTRACT

An ultra-clean transportation and storage system includes a product storage container with a base having product supports and a segmented lid enclosing the product supports. Rollers on the base have grooved sidewalls receiving a rail to support the product storage container and rolling along the rail edges. Lift-off hinges allow lid removal only after a predetermined rotation. Seals, a one-way breather valve, and a gas inlet allow the interior of the enclosure to be purged. A friction brake on the product storage container has an integrated O-ring contact surface and a housing enclosing complementary acme threads for moving the brake. A transfer cart includes a rail on the lift arm to support the product storage container during movement, and alignment and docking mechanisms on a transfer end effector of the lift are for docking with either a storage spaced on a storage rack or a transfer space on a pass-through.

20 Claims, 20 Drawing Sheets

(56) References Cited

U.S. PATENT DOCUMENTS 4,456,228 A * 6/1984 Cable ..... B23K 7/10 266/70
5,351,415 A 10/1994 Brooks et al.
5,547,421 A * 8/1996 Scheetz ..... B65D 90/34 206/335
5,642,811 A * 7/1997 Hubner ..... B65D 19/44 206/303
5,788,082 A 8/1998 Nyseth
6,056,499 A 5/2000 Bressner
6,598,756 B1 * 7/2003 Rosenfeldt ..... B65D 19/16 206/600
6,652,213 B1 * 11/2003 Mitchell ..... B65G 1/0492 414/279
7,743,938 B2 * 6/2010 Wu ..... B65D 25/107 206/205
8,523,201 B2 * 9/2013 Allen ..... A45C 5/14 206/314
2004/0065224 A1 * 4/2004 Gilbert ..... A47B 53/02 104/137
2004/0105733 A1 * 6/2004 Hewitt ..... B60P 7/08 410/66
2005/0179235 A1 * 8/2005 Stewart ..... B60J 7/1614 280/656
2006/0045672 A1 * 3/2006 Maynard ..... B25J 5/02 414/276
2009/0178946 A1 * 7/2009 Patstone ..... B65D 21/0223 206/503
2014/0252935 A1 * 9/2014 McAdoo ..... E05D 7/105 312/326
2015/0307253 A1 * 10/2015 Paoli ..... A45C 1/00 206/524.8
2016/0137343 A1 * 5/2016 Weng ..... B65D 19/06 206/386
2016/0168880 A1 * 6/2016 Phelan ..... B65D 55/14 206/1.5

OTHER PUBLICATIONS

Alum-a-lift Ergonomic Material Handling Lifts; http://alum-a-lift.com/; printed Dec. 22, 2015; 2 pages.
Metro Wire Shelving Metro.com; http://www.metro.com/shelving/wire-shelving; printed Dec. 22, 2015; 3 pages.
Metro Bins Metro.com; http://www.metro.com/accessories/storage-bins; printed Dec. 22, 2015; 3 pages.

* cited by examiner

METHOD AND APPARATUS FOR ULTRA-CLEAN SEEKER TRANSPORTATION AND STORAGE

TECHNICAL FIELD

The present disclosure is directed in general to clean-room manufacturing, and, more particularly, to storage and transportation of sensitive equipment within and between clean-rooms and external environments.

BACKGROUND OF THE DISCLOSURE

Particles interfering with operation of sensitive sensor systems may contaminate sensor surfaces during production, even when production occurs within a clean room. Storage and transportation components used within the production process can be one significant source of contaminating particles.

SUMMARY OF THE DISCLOSURE

The ultra-clean transportation and storage system of the present disclosure preferably includes at least a product storage container formed by a base platform with product supports mounted on a top surface of the base platform, where the product supports configured to support a product. The product storage container is also formed by a lower lid segment detachably secured to the base platform and surrounding at least lower portions of the product supports. The product storage container is further formed by an upper lid segment detachably secured to the lower lid segment, wherein the upper lid segment surrounds at least upper portions of the product supports and extends over the product supports, and where the base platform, the lower lid segment, and the upper lid segment form an enclosure around the product supports. The product storage container includes a plurality of rollers mounted on a bottom surface of the base platform, each of the rollers having grooved sidewalls configured to receive and roll along ends of a rail, where the product storage container is supported by contact of the rollers with the rail. The upper lid segment of the product storage container is optionally secured to the lower lid segment at least in part by lift-off hinges configured to allow separation of the upper lid segment from the lower lid segment only after the upper lid segment has been rotated around the lift-off hinges by at least 90° from a closed position. Optional seals within an interface between the lower lid segment and the base platform and between the upper lid segment and the lower lid segment are configured to seal the enclosure. An optional one-way breather valve on the product storage container configured to maintain slight positive internal pressure, allow gas to be expelled from the enclosure, and an optional gas inlet on the product storage container is configured to allow gas to be injected into the enclosure to purge the interior. An optional friction brake for the product storage container is mounted to the base platform and includes: a revolving brake pad having an integrated O-ring contact surface and movable between braking and non-braking positions, where the contact surface configured to contact a portion of the rail in the braking position to inhibit movement of the product storage container along the rail; and a housing enclosing complementary acme threads configured to move the brake pad. The product storage container optionally includes handles secured to portions of the base platform extending outside the lower lid segment, support beams secured to the bottom surface of the base platform, with at least one of the support beams including a rail entry configured to allow the rail to be inserted between the rollers, and at least one stop mounted on one of the support beams and configured to limit movement of the product storage container along the rail.

The ultra-clean transportation and storage system of the present disclosure also preferably includes a transfer cart formed by a vertical support mounted on a movable base, with a lift arm movable along the vertical support and a rail mounted on the lift arm, the rail having edges configured to be received by grooved sidewalls of rollers mounted on a bottom surface of a product storage container and configured to support the product storage container. A transfer end effector on an end of the lift arm is configured to enter a front of a product container storage space within a product container support structure and to vertically and horizontally align an end of the rail on the lift arm with an end of a rail on the product container support structure. The transfer end effector optionally includes a plurality of horizontal rollers spaced to roll along inside faces of vertical uprights of the product support structure, to ensure lateral horizontal alignment of the end of the rail on the lift arm with the end of the rail on the product container support structure. The transfer end effector also optionally includes a plurality of vertical rollers spaced to roll along angled corner faces of vertical uprights of the product support structure, to ensure depth-wise horizontal alignment between the end of the rail on the lift arm with the end of the rail on the product container support structure. The vertical rollers are preferably configured to be received by vertical safety stop catches on the vertical uprights of the product support structure, to inhibit depth-wise horizontal movement of the lift arm when the vertical rollers are received by the vertical safety stop catches. The transfer end effector further optionally includes at least one of fixed vertical limit stop and a spring loaded movable gate including a gate stop, each of the fixed vertical limit stop and the gate stop on the spring loaded movable gate configured to engage a counterpart structure on a horizontal beam of the product container support structure, to limit vertical movement of the lift arm and ensure vertical alignment between the end of the rail on the lift arm with the end of the rail on the product container support structure.

The ultra-clean transportation and storage system of the present disclosure further preferably includes a storage rack forming a plurality of storage spaces and formed by: vertical uprights adjacent each of the storage spaces, where the vertical uprights including inner faces and angled corner faces; a horizontal beam at a bottom of each of the storage spaces; and a rail extending into each of the storage spaces, with the rail having an end configured to be received by grooved sidewalls of rollers mounted on a bottom surface of a product storage container rolled onto the rail along edges of the rail, the rail configured to support the product storage container. The inside faces of vertical uprights are preferably configured to receive a plurality of horizontal rollers on a transfer end effector of a transfer cart and are spaced for the plurality of horizontal rollers to roll along of the inside faces, to ensure lateral horizontal alignment between the end of the rail in a respective one of the storage spaces and an end of a rail on the transfer cart. The angled corner faces of the vertical uprights are preferably configured to engage a plurality of vertical rollers on a transfer end effector of a transfer cart and are spaced for the plurality of vertical rollers to roll along the angled corner faces, to ensure depth-wise horizontal alignment between the end of the rail in a respective one of the storage spaces and an end of a rail on the transfer cart. The storage rack optionally includes vertical safety stop catches on the angled corner faces of vertical uprights configured to receive the vertical rollers, to inhibit depth-wise horizontal movement of the transfer cart when the vertical rollers are received by the vertical safety stop catches. The storage rack also optionally includes at least one of a fixed stop catch and a spring loaded movable gate including a gate stop catch mounted on the horizontal beam, each of the fixed stop catch and the gate stop catch on the spring loaded movable gate configured to engage a counterpart structure on a transfer end effector of the transfer cart, to limit vertical movement of the transfer end effector and ensure vertical alignment between the end of the rail on the lift arm with the end of the rail in a respective one of the storage spaces and an end of a rail on the transfer cart.

The ultra-clean transportation and storage system of the present disclosure still further preferably includes a pass-through formed by: a frame having a product storage container transfer opening, where the frame is configured to be installed within a wall between two spaces; a window mounted within the frame and configured to be moved, in conjunction with movement of enclosed counter-balanced weights coupled to the window, between a closed position in which the window covers the product storage container transfer opening and an open position in which at least a portion of the product storage container transfer opening is not covered by the window; and at least one product storage container transfer space adjacent the product storage container transfer opening, where the at least one product storage container transfer space includes: vertical uprights adjacent the at least one product storage container transfer space, the vertical uprights including inner faces and angled corner faces; a horizontal beam at a bottom of at least one product storage container transfer space; and a rail extending into at least one product storage container transfer space, the rail having an end configured to be received by grooved sidewalls of rollers mounted on a bottom surface of a product storage container rolled onto the rail along edges of the rail, the rail configured to support the product storage container. The inside faces of vertical uprights are preferably configured to receive a plurality of horizontal rollers on a transfer end effector of a transfer cart and are spaced for the plurality of horizontal rollers to roll along of the inside faces, to ensure lateral horizontal alignment between the end of the rail in a respective one of the storage spaces and an end of a rail on the transfer cart. The angled corner faces of the vertical uprights are preferably configured to engage a plurality of vertical rollers on a transfer end effector of a transfer cart and are spaced for the plurality of vertical rollers to roll along the angled corner faces, to ensure depth-wise horizontal alignment between the end of the rail in a respective one of the storage spaces and an end of a rail on the transfer cart. The storage rack optionally includes vertical safety stop catches on the angled corner faces of vertical uprights configured to receive the vertical rollers, to inhibit depth-wise horizontal movement of the transfer cart when the vertical rollers are received by the vertical safety stop catches. The storage rack also optionally includes at least one of a fixed stop catch and a spring loaded movable gate including a gate stop catch mounted on the horizontal beam, each of the fixed stop catch and the gate stop catch on the spring loaded movable gate configured to engage a counterpart structure on a transfer end effector of the transfer cart, to limit vertical movement of the transfer end effector and ensure vertical alignment between the end of the rail on the lift arm with the end of the rail in a respective one of the storage spaces and an end of a rail on the transfer cart.

Although specific advantages have been enumerated above, various embodiments may include some, none, or all of the enumerated advantages. Additionally, other technical advantages may become readily apparent to one of ordinary skill in the art after review of the following figures and description.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
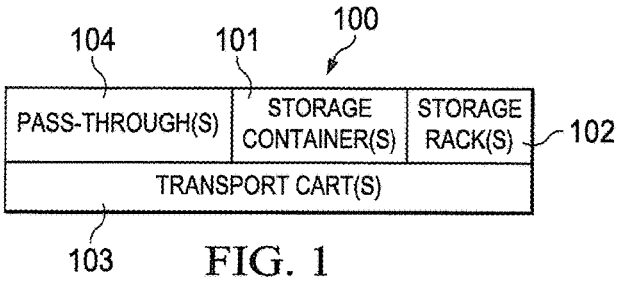
FIG. 1 is a block diagram conceptually illustrating components of ultra-clean transportation and storage system and the interoperation of those components in accordance with embodiments of the present disclosure.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below. Additionally, unless otherwise specifically noted, articles depicted in the drawings are not necessarily drawn to scale.

State of the art precision space sensors and associated systems employ assemblies that are becoming more sensitive to particulate contamination. In particular, the optics for space-borne sensors are sensitive to contamination by particles of foreign object debris (FOD) entering into the optics, and are accordingly assembled in cleanrooms. While rework cleaning operations could generally remove particles of concern from in the past, such rework cleaning operations are no longer sufficient to provide products that meet performance requirements for next generation sensors. Particle artifacts in these advanced sensor systems have become increasingly problematic relative to object sensing areas and now require cleaner manufacturing, transportation, and storage solutions to prevent the introduction of particles during manufacturing and test. In addition, these systems are susceptible to physical damage from moderate physical contact with other objects that may occur in the absence of sufficient safeguards against such physical contact. A clean, error-proof and space-efficient means for critical environment (cleanroom) storage and transportation of sensitive complex mechanical elements is necessary to meet performance requirements for production with satisfactory yield.

Figure 1A:
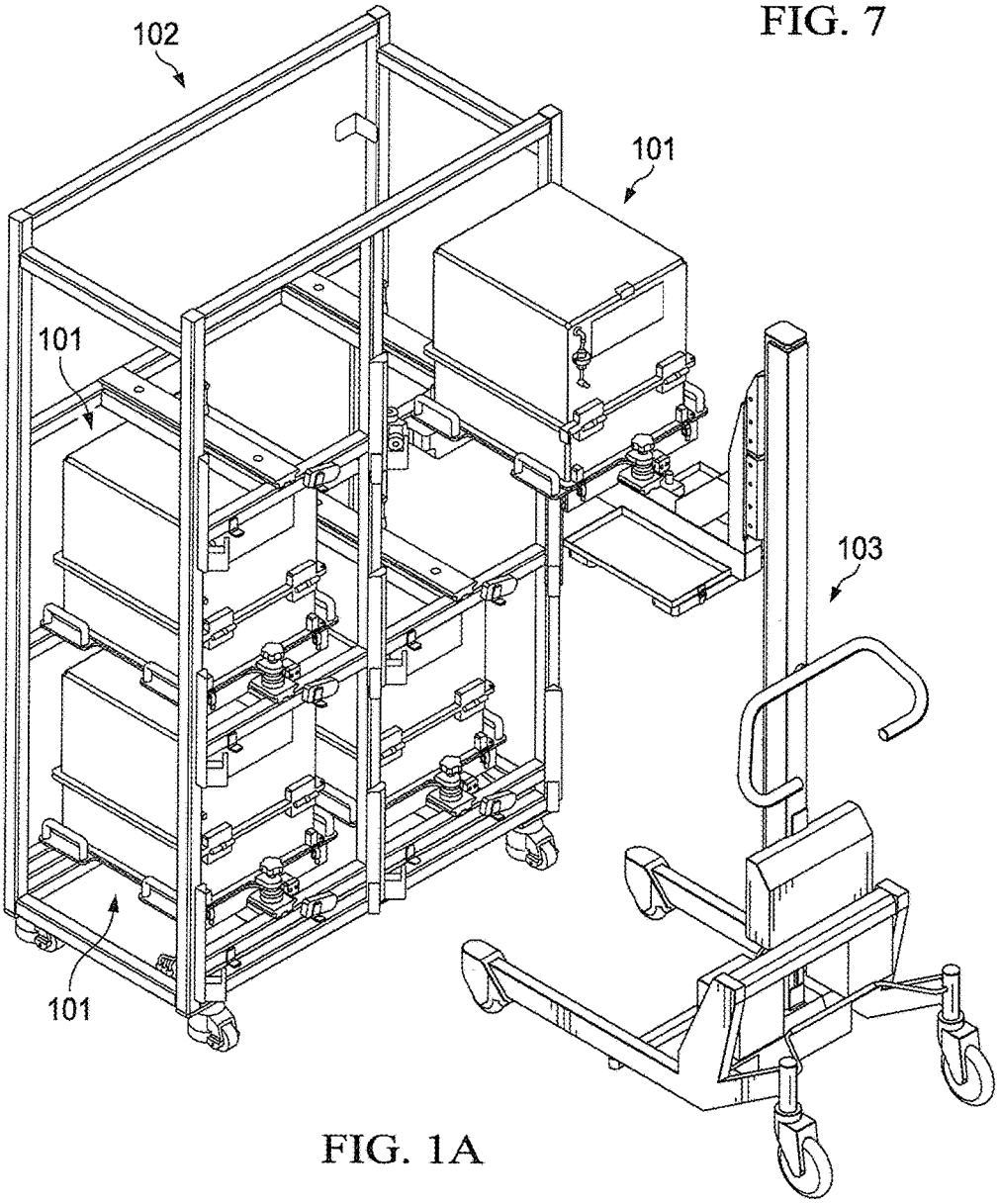
FIGS. 1A and 1B are perspective views of implementations of the components of the ultra-clean transportation and storage system of FIG. 1.
Figure 1B:
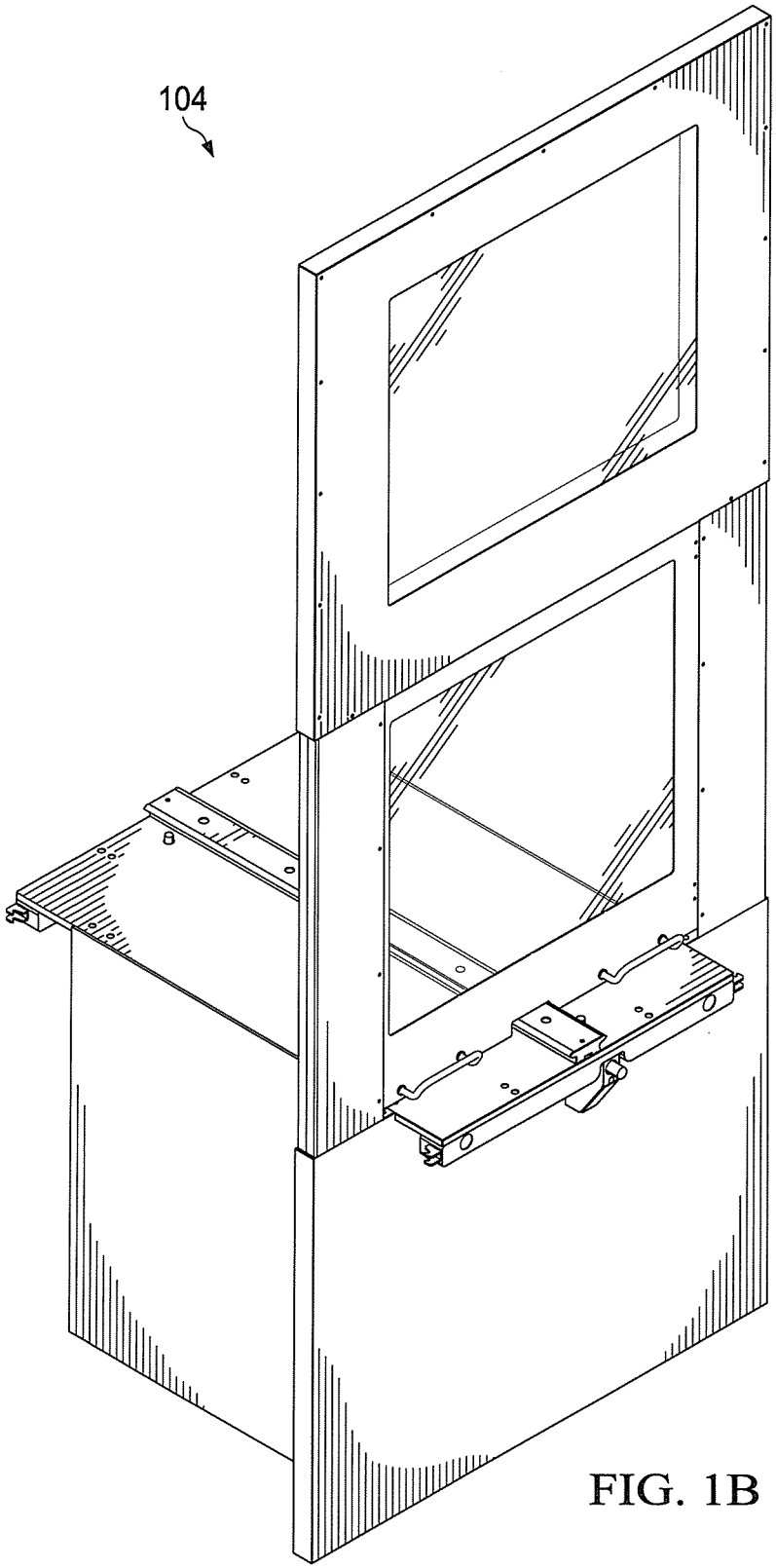

FIG. 1 is a block diagram conceptually illustrating components of ultra-clean transportation and storage system and the interoperation of those components in accordance with embodiments of the present disclosure. FIGS. 1A and 1B are perspective views of implementations of the components of the ultra-clean transportation and storage system of FIG. 1. A single instance of the ultra-clean transportation and storage system 100 includes a plurality of storage containers 101 each configured to hold one of the manufacturing products during the transportation and storage required for assembly and testing. At least one storage rack 102 holds products within the storage containers 101 between periods of assembly and between completion of production and release. The storage rack(s) 102 are designed to interoperate with the storage containers 101 to receive, hold, and allow removal of the storage containers 101 with reduced particulate generation. At least one transfer cart 103 enables movement of the storage containers 101 with assembled or partially assembled products therein, interoperating with the storage containers 101 and the storage rack(s) 102 to transfer storage containers 101 with reduced particulate generation.

Figure 2:
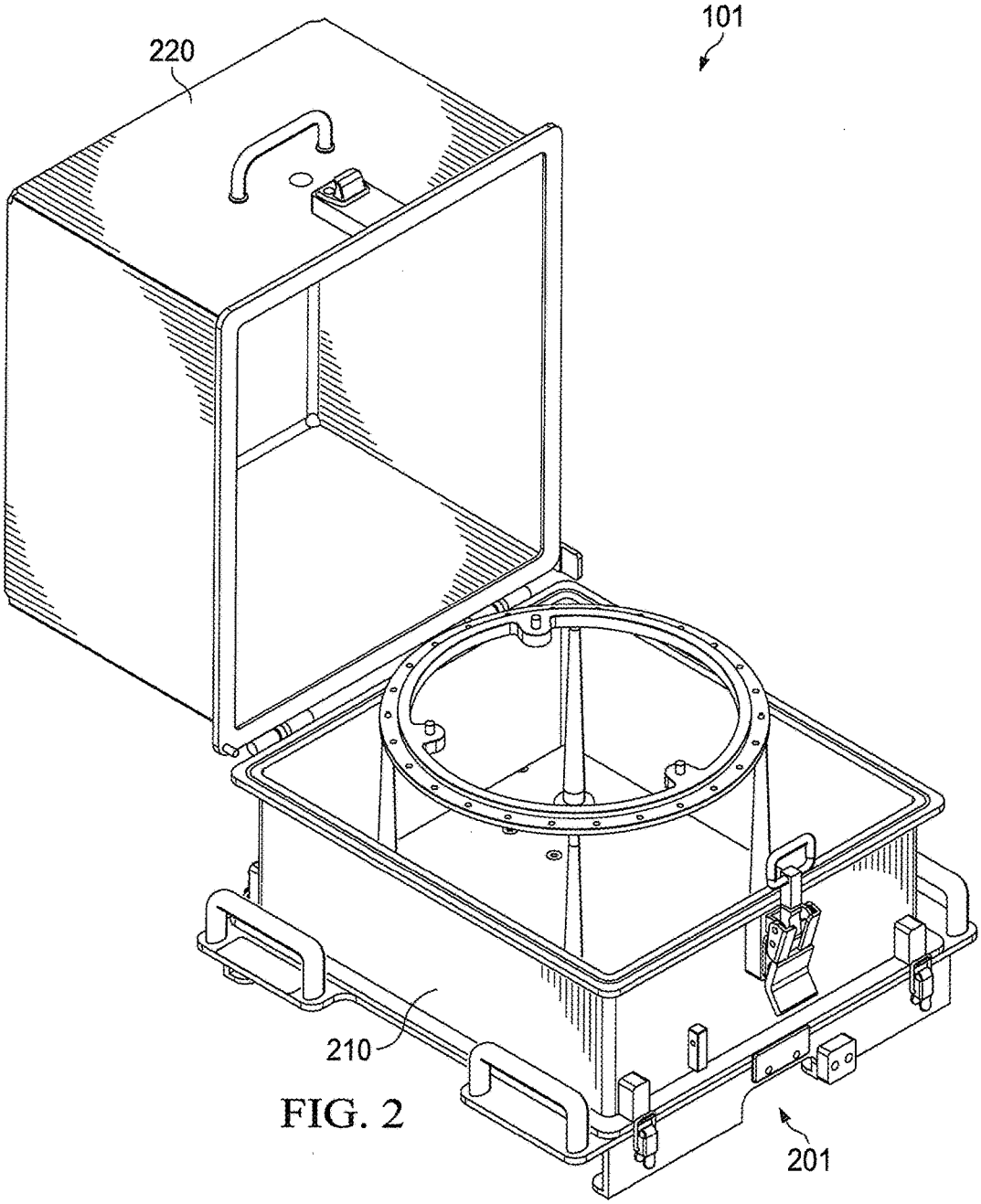
FIG. 2 is a perspective view of an ultra-clean material storage container with integrated purge capability, a rail transfer mechanism, and a segmented, removable lid for use within the ultra-clean transportation and storage system of FIG. 1.
Figure 2A:
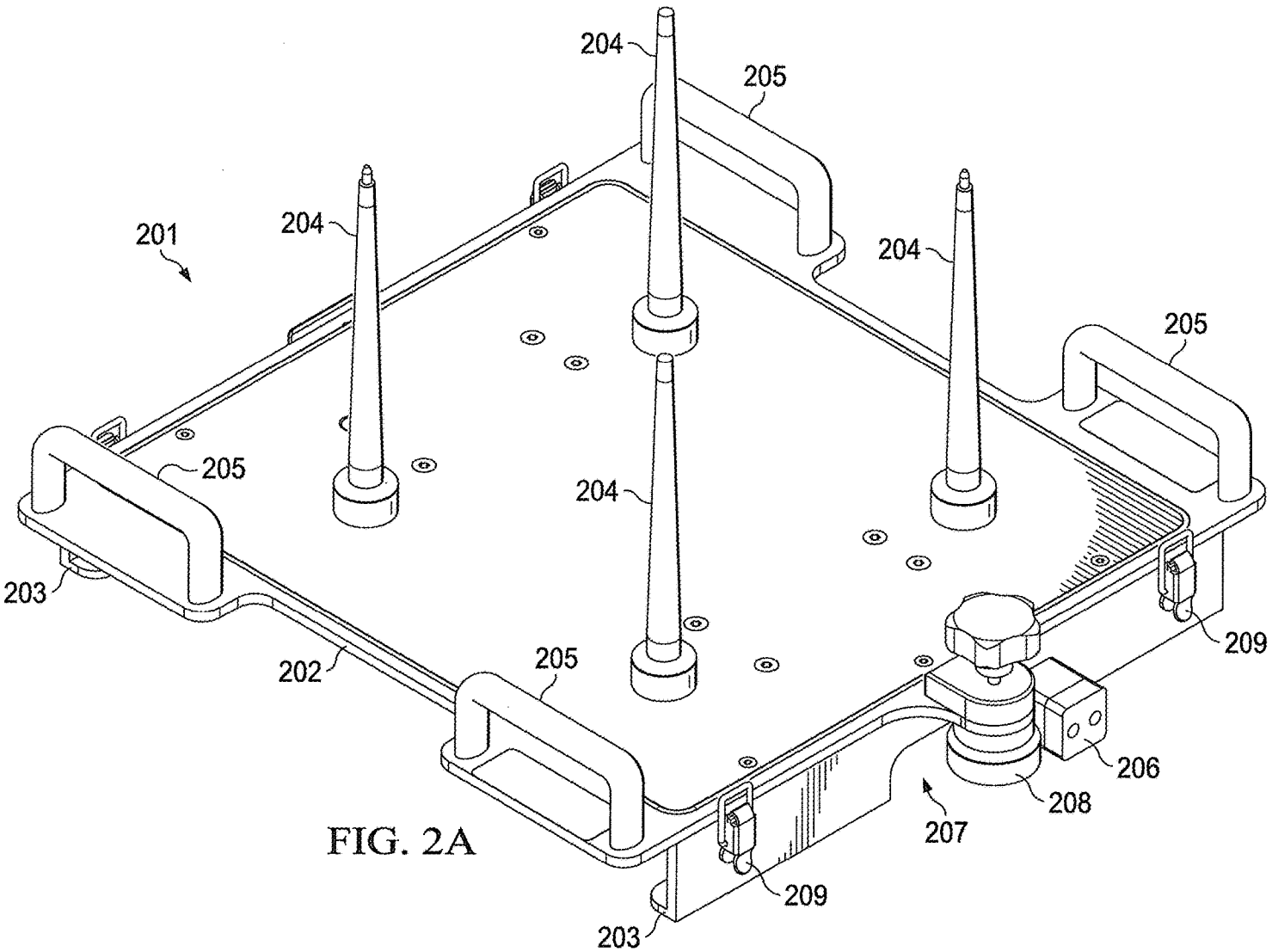
FIGS. 2A to 2E are alternate views of the ultra-clean material storage container of FIG. 2, showing further details of the ultra-clean material storage container in various stages of closure.

FIG. 2 is a perspective view of an ultra-clean material storage container with integrated purge capability, a rail transfer mechanism, and a segmented, removable lid for use within the ultra-clean transportation and storage system of FIG. 1. FIGS. 2A to 2E are alternate views of the ultra-clean material storage container of FIG. 2, showing further details of the ultra-clean material storage container in various stages of closure. FIG. 2A shows the ultra-clean material storage container when completely open and, in the example shown, not supporting any product. The ultra-clean material storage container 101 includes a base 201 including a base platform 202 supported on base support beams 203. The base platform 202 is a generally thin and rectangular sheet secured to the base support beams 203, which have a C-shaped cross-section in the example shown. Protruding from and secured to an upper surface of the base platform 202 are product supports 204, which in the example shown comprise four spikes or post supports (although more or fewer product supports may be required or sufficient for particular applications). Product supports 204 are arranged to support a partially or fully assembled product within the ultra-clean material storage container 101 by having a support structure (e.g., a support ring) on the product rest on the upper ends of the product supports 204. The rest surface of the support structure is in the form of a pin-to-bushing interface that allows for commonality and compatibility across multiple handling rings and hardware platforms. The upper ends of product supports 204 may be adapted to secure the partially or fully assembled product to those (e.g., by handling rings, screws, latches or clamps), to hold the product in position within the ultra-clean material storage container 101 during movement.

Handles 205 are secured to extensions on each corner of base platform 202 of the ultra-clean material storage container 101, facilitating manual guidance of the container during movement. At least one stop 206 protrudes from one of base support beams 203 proximate to a rail entry 207 through that support beam, to limit movement of the container on (for example) the transfer cart 103. One or more additional stops may protrude from the opposite base support beam to limit movement of the container into a storage rack. An ultra-clean, manually-activated friction brake 208 is secured to an extension of the base platform 202 along one side, proximate to the rail entry. Except for the knob, a portion of the shaft, and the brake pad, the movable portions of friction brake 208 are completely sealed within the brake housing, so that few particles (if any) are released during operation. An acme actuation thread on a portion of the shaft between the knob and the brake pad moves the brake pad between braking and non-braking positions in response to rotation of the knob. The revolving brake pad on friction brake 208 includes an integrated O-ring contact surface that establishes and maintains friction with a supporting rail without (or with minimal) particulate generation. As noted above, at least one of base support beams 203 includes a rail entry 207 through the portion next to the brake pad, for receiving a transfer rail described in further detail below. Optionally, both base support beams 203 may include such a rail entry (and the associated stop 206, with or without an additional friction brake 208) for loading the container onto a transfer cart or into a storage rack from either side. Lower lid latches 209 mounted along the sides of base support beams 203 and/or edges of base platform 202 allow the lower lid segment to be secured to the base platform 202.

Figure 2B:
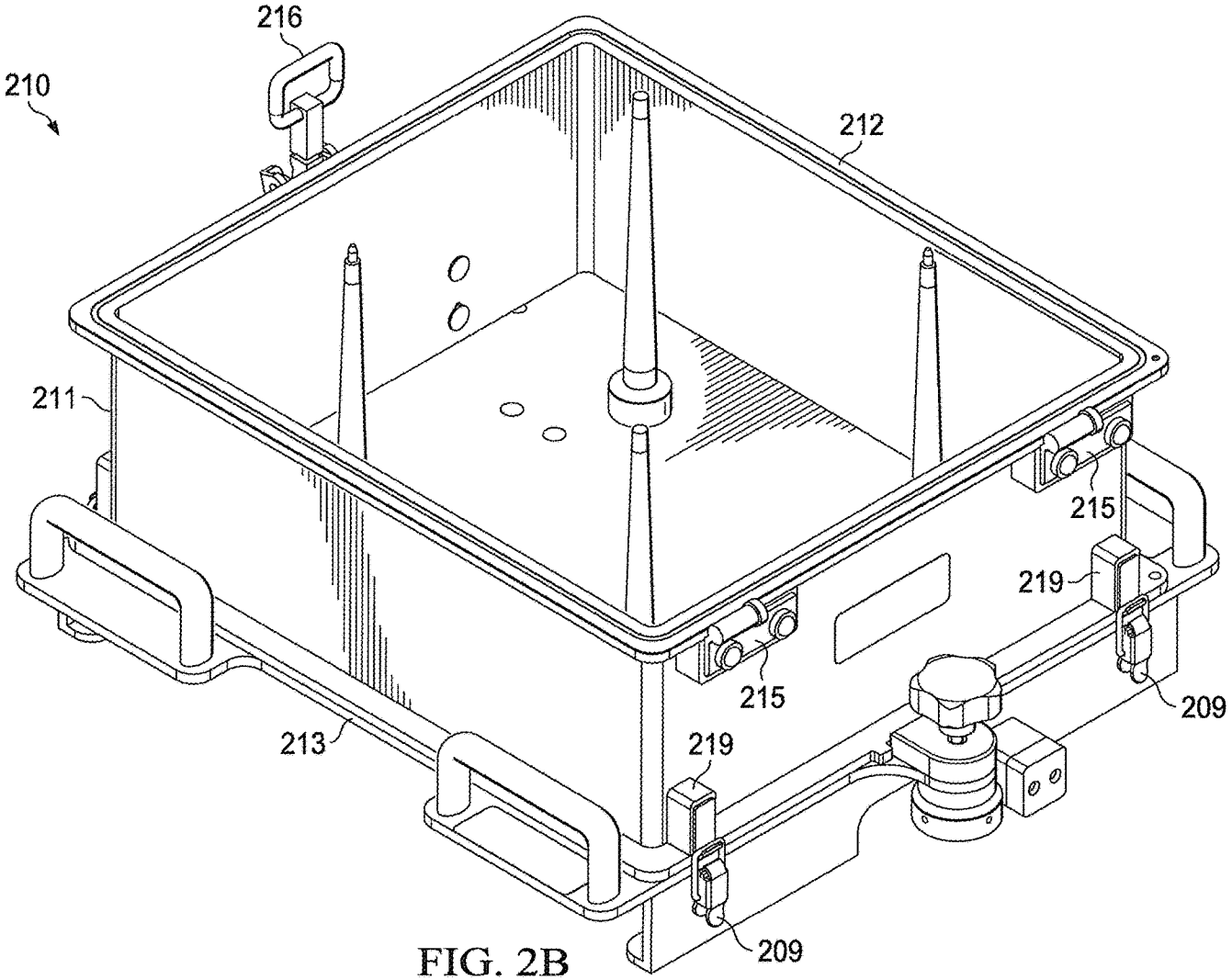

FIG. 2B shows the ultra-clean material storage container 101 with a lower lid segment 210 secured to the base platform. The lid for the ultra-clean material storage container 101 is segmented into upper and lower lids, allowing for multiple configurations of the closed container (e.g., by varying the height of the lower lid segment 210) and reducing risks to the product during lid installation and removal as described below. The lower lid segment 210 includes an annular, rectangular sidewall structure 211 having upper and lower rims 212 and 213, respectively, and is arranged to rest on the upper surface of the base platform 202 surrounding at least the product supports 204 and, in some embodiments, a lower portion of the supported product. In some instances, the lower lid segment 210 may be secured to the base 201 prior to placing a product on the product supports of the base, to avoid the risk of inadvertent contact between and/or contamination by a supported product and the lower lid segment 210 during closure of the ultra-clean material storage container 101.

The upper and lower rims 212 and 213 of the lower lid segment 210 each include a captive O-ring within a groove in the surface opposite the sidewall structure 211, for sealing respectively the interface between the lower lid segment 210 and the upper lid segment 220 and the interface between the lower lid segment and the upper surface of the base platform 202. Alternatively, a captive O-ring may be included only within the lower rim 213 of the lower lid segment 210, with a captive O-ring on the upper lid segment 220 sealing the interface between the lower lid segment 210 and the upper lid segment 220. Latch points 219 on the lower exterior of sidewall structure 211 near the lower rim 213 allow the lower lid segment 210 to be secured to and sealed with the upper surface of base platform 202 by latches 209. Lift-off hinge portions 215 on one side of the lower lid segment 210, on the upper exterior of sidewall structure 211 near the upper rim 213, receive counterpart portions of lift-off hinges on the upper lid segment 220 as described below. A latch portion 216 on the opposite side of the lower lid segment 210 from the lift-off hinge portions 215, also on the upper exterior of sidewall structure 211 near the upper rim 213, cooperates with a corresponding latch point on the upper lid segment 220 to secure (together with the lift-off hinges) the upper and lower lid segments 220 and 210 to each other.

Figure 2C:
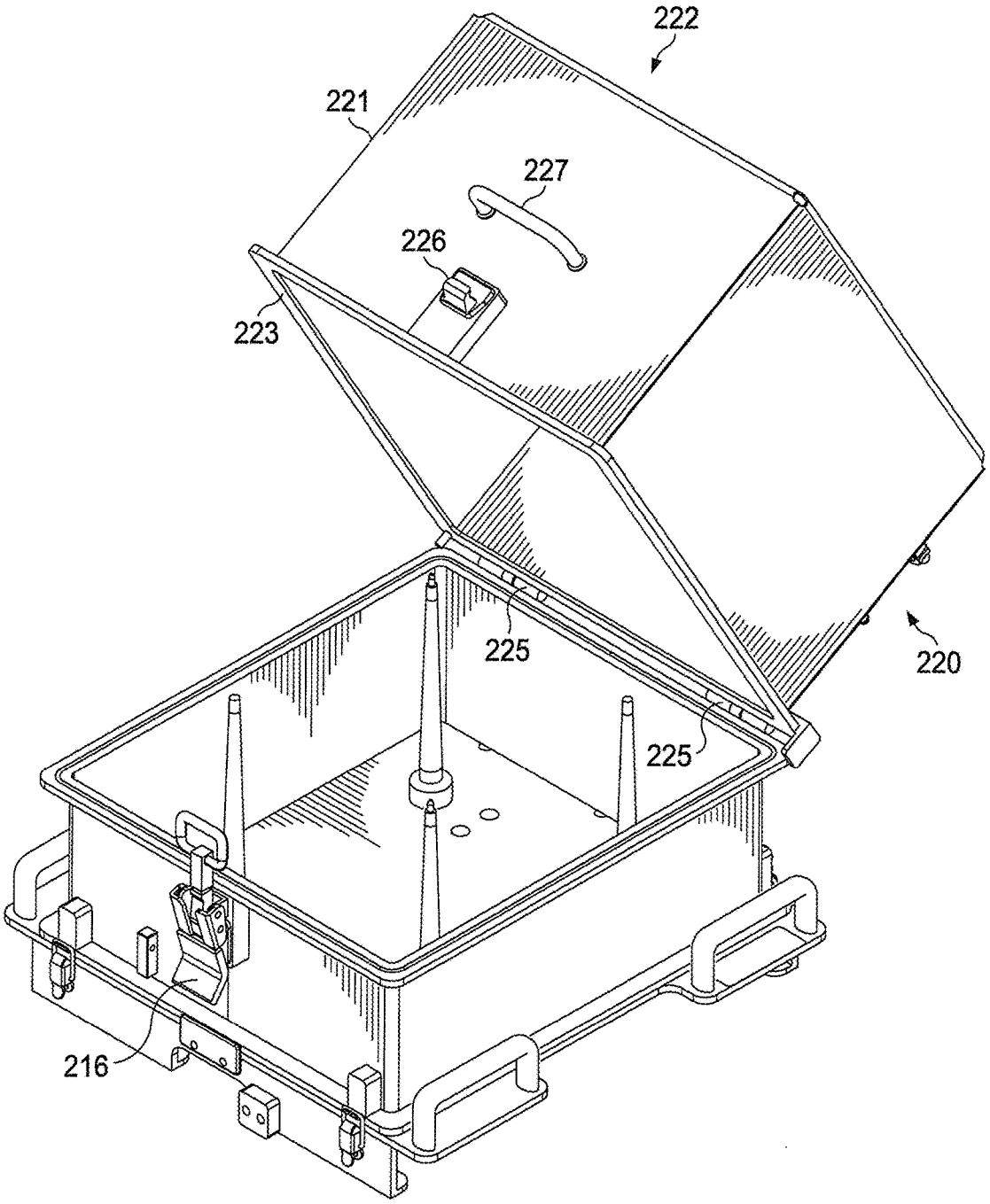

FIG. 2C shows the ultra-clean material storage container 101 with the lower lid segment 210 secured to the base platform and the upper lid segment attached but in a partially open position. The upper lid segment 220 includes an annular sidewall structure 221 with a top surface 222 covering one end and an upper lid rim 223 around an opposite, open end. The upper lid segment 220 is arranged to rest on the upper surface of the upper rim 212 of the lower lid segment 210, surrounding in some cases the upper portions of the product supports 204 and, in some embodiments, an upper portion of the supported product. The upper lid rim 223 mates with the upper rim 212 of the lower lid segment 210, with the captive O-ring within a groove in either the upper lid rim 223 or the upper rim 212 sealing the interface between the lower lid segment 210 and the upper lid segment 220. Lift-off hinge portions 225 on one side of the upper lid segment 220, on the lower exterior of sidewall structure 221 near the upper lid rim 223, receive counterpart portions 215 of the lift-off hinges that are secured to the lower lid segment 210. Latch point 226 on the opposite lower exterior of sidewall structure 221 near the upper lid rim 223 allows the upper lid segment 220 to be secured to and sealed with the lower lid segment 201 by latch portion 216.

When the ultra-clean material storage container 101 is fully assembled and closed, the lift-off hinges and the latch portion 216 and latch point 226 secure the upper lid segment 220 to the lower lid segment 210 and seal the interface between the two lid segments. However, the lift-off hinges are arranged to allow removal of the upper lid segment 220 from the lower lid segment 210 without removal of any of lift-off hinge portions 215 or 225 from either lower or upper lid segments 210 or 220. Moreover, the lift-off hinges are also arranged to prevent removal of the upper lid segment 220 from the lower lid segment 210 before the lower lid segment has been rotated by 90° from the closed position around the lift-off hinges. This feature provides integrated error-proofing to opening and closure of the ultra-clean material storage container 101. Since the upper lid segment 220 cannot be detached from the lower lid segment 210 until opened past 90°, contact with contained hardware (i.e., the supported product) due to lateral shifts is prevented during closure or removal of the upper lid segment, reducing the risk of damage or contamination during lid installation or removal.

Figure 2D:
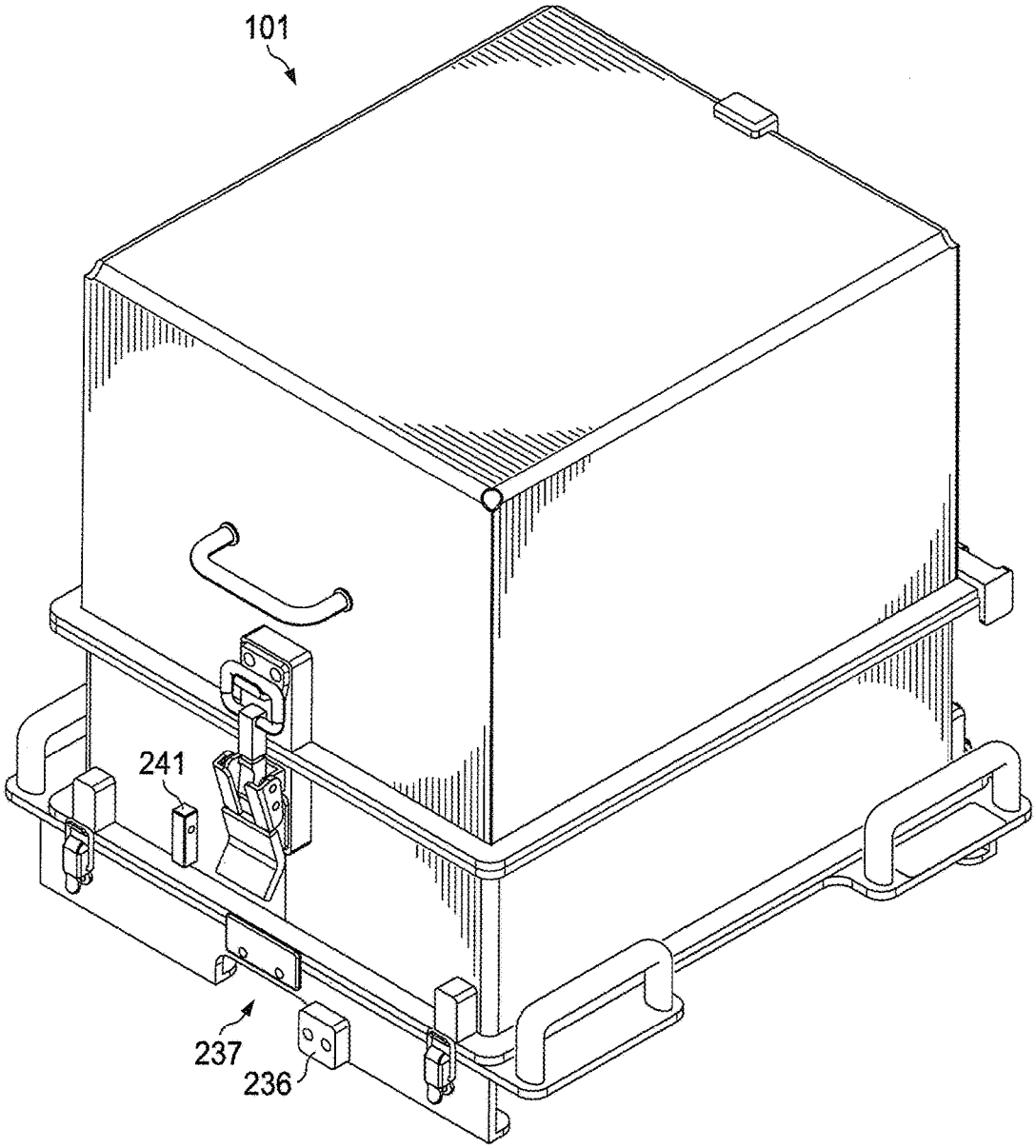
Figure 2E:
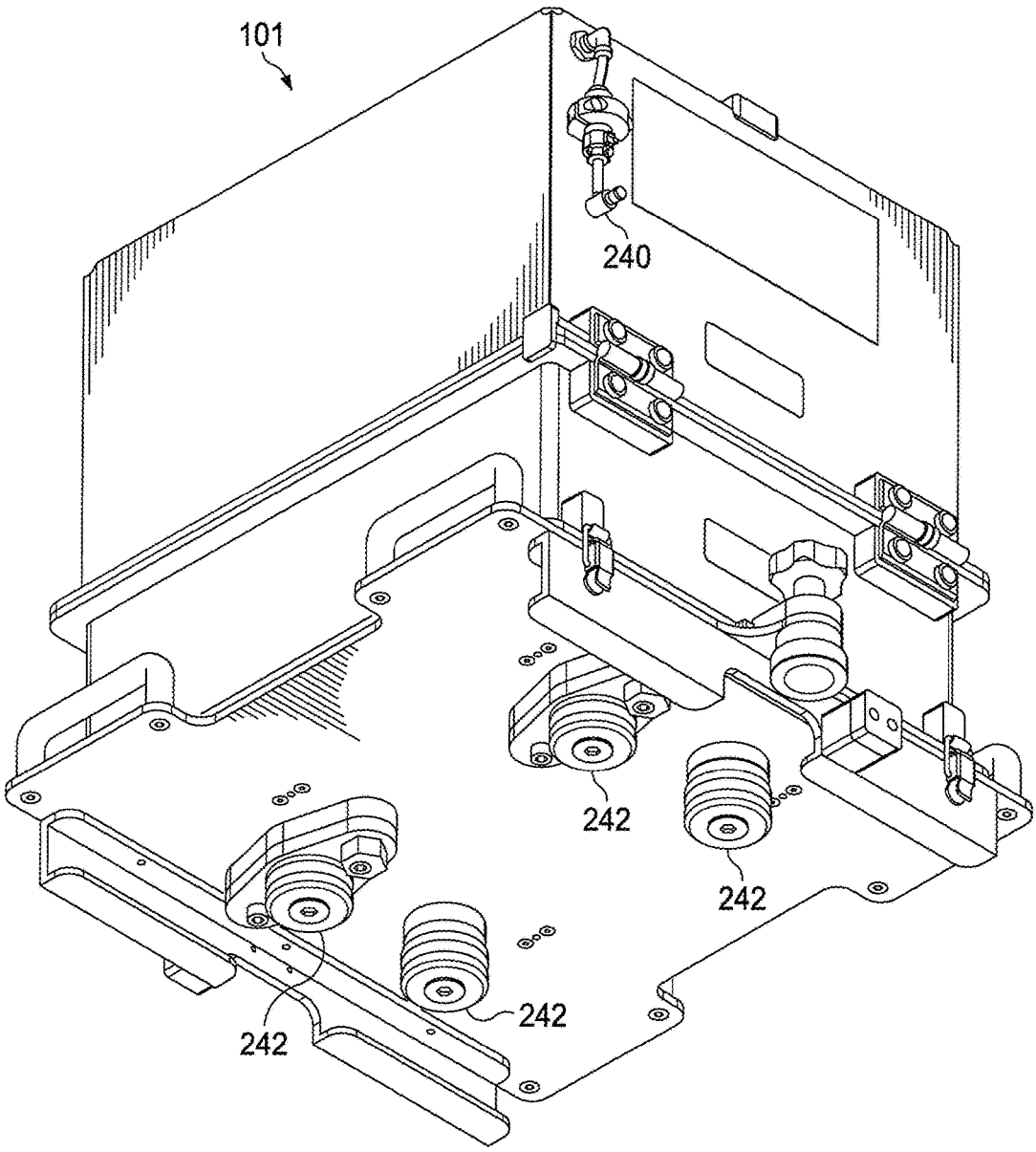

FIG. 2D shows the completely assembled and fully closed and secured ultra-clean material storage container 101 from an upper perspective, while FIG. 2E shows the completely assembled and fully closed and secured ultra-clean material storage container 101 from a lower perspective. With the base platform and upper and lower lid segments positioned as shown in FIGS. 2D and 2E, the supported product is fully enclosed and protected, and the interfaces between the lower lid segment and the upper lid segment and between the lower lid segment and the upper surface of the base platform are sealed. When closed and sealed, the ultra-clean material storage container 101 need not necessarily be kept inside a cleanroom, allowing the sensitive product contained therein to effectively be stored in a "dirty" area while remaining clean inside the ultra-clean material storage container 101. As visible from the perspective of FIG. 2D, the base 201 includes a stop 236 and a rail entry 237 through the second support beam, opposite those depicted in FIGS. 2A and 2B. No friction brake on the opposite side is necessary, as the single friction brake described above is sufficient for securing the ultra-clean material storage container 101 on a transfer cart or storage rack. As visible from the perspective of FIGS. 2D and 2E, the upper lid segment includes a filtered gas (e.g., nitrogen) inlet 240 for purge capability. A one-way breather valve 241 maintains positive pressure inside the sealed, ultra-clean material storage container 101 while also allowing adhesives on the supported product to cure while inside container without cross contamination. Also visible from the perspective of FIG. 2E, a bottom surface of the base includes integrated support for a cleanroom rail system, in the form of rollers 242, which interface a cleanroom rail and permit transfer and positioning of the ultra-clean material storage container 101 along the rail.

All hardware components on the ultra-clean material storage container 101 that have been described above (e.g., product supports 204, handles 205, latches 209 and latch points 219, lift-off hinge portions 215 and 225, etc.) are preferably cleanroom-rated components or, if custom rather than off-the-shelf, are made with materials and manufacturing techniques producing cleanroom-rated components.

Figure 3:
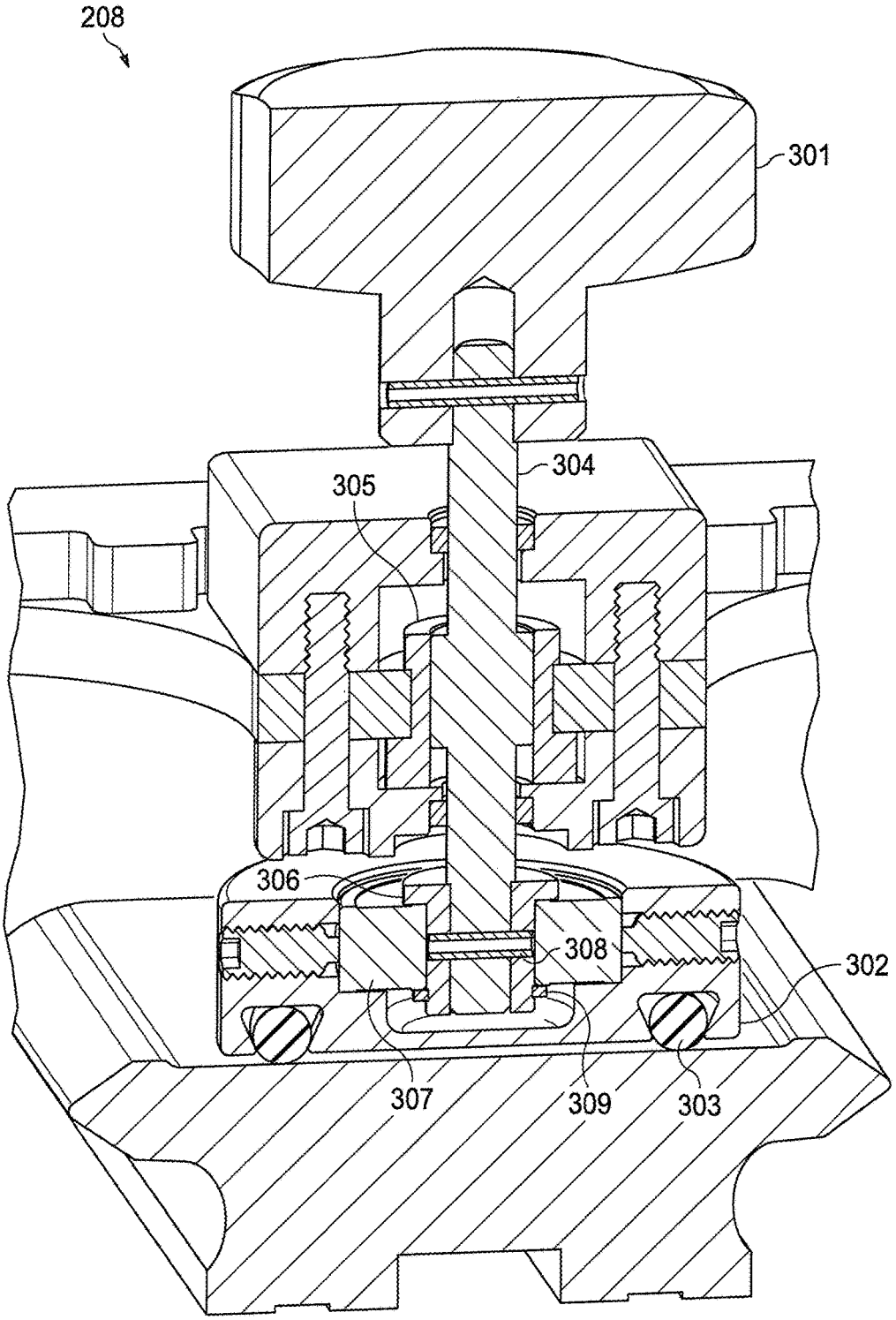
FIG. 3 is a sectional view of the ultra-clean, hand-operated, friction rail brake depicted in FIGS. 2A, 2B, and 2E.

FIG. 3 is a sectional view of the ultra-clean, hand-operated, friction rail brake depicted in FIGS. 2A, 2B, and 2E. Friction brake 208 includes a hand-actuation knob 301 for moving the revolving brake pad 302 between braking and non-braking positions. As described above, the contact surface of the brake pad 302 includes a durable synthetic O-ring 303 made, for example, from ethylene propylene diene monomer (EPDM). A brake shaft 304 connecting the knob 301 with the brake pad 302 passes through an acme nut 305 and is received by an adapter sleeve 306 between the shaft 304 and a sealed, stainless bearing 307. The brake shaft 304 is held in fixed position relative to the adapter sleeve 306 by a roll pin 308, while a retaining ring 309 holds the adapter sleeve 306 in position relative to the bearing 307. With the thread mechanisms for actuating or releasing the friction brake 208 positioned inside the sealed housing around the brake shaft 304, most particles generated by rotating the brake shaft 304 should remain contained in the housing. As the brake is engaged or disengaged, the revolving bake pad 302 makes contact with the surface of a rail but the bearing 307 allows the mechanism to function without creating sliding motion against the brake pad surface (that is, the brake pad 302 can remain stationary even as the shaft 304 is rotated to increase or decrease the force between the brake pad surface and the rail). This mechanism reduces particulate generation.

Figure 4:
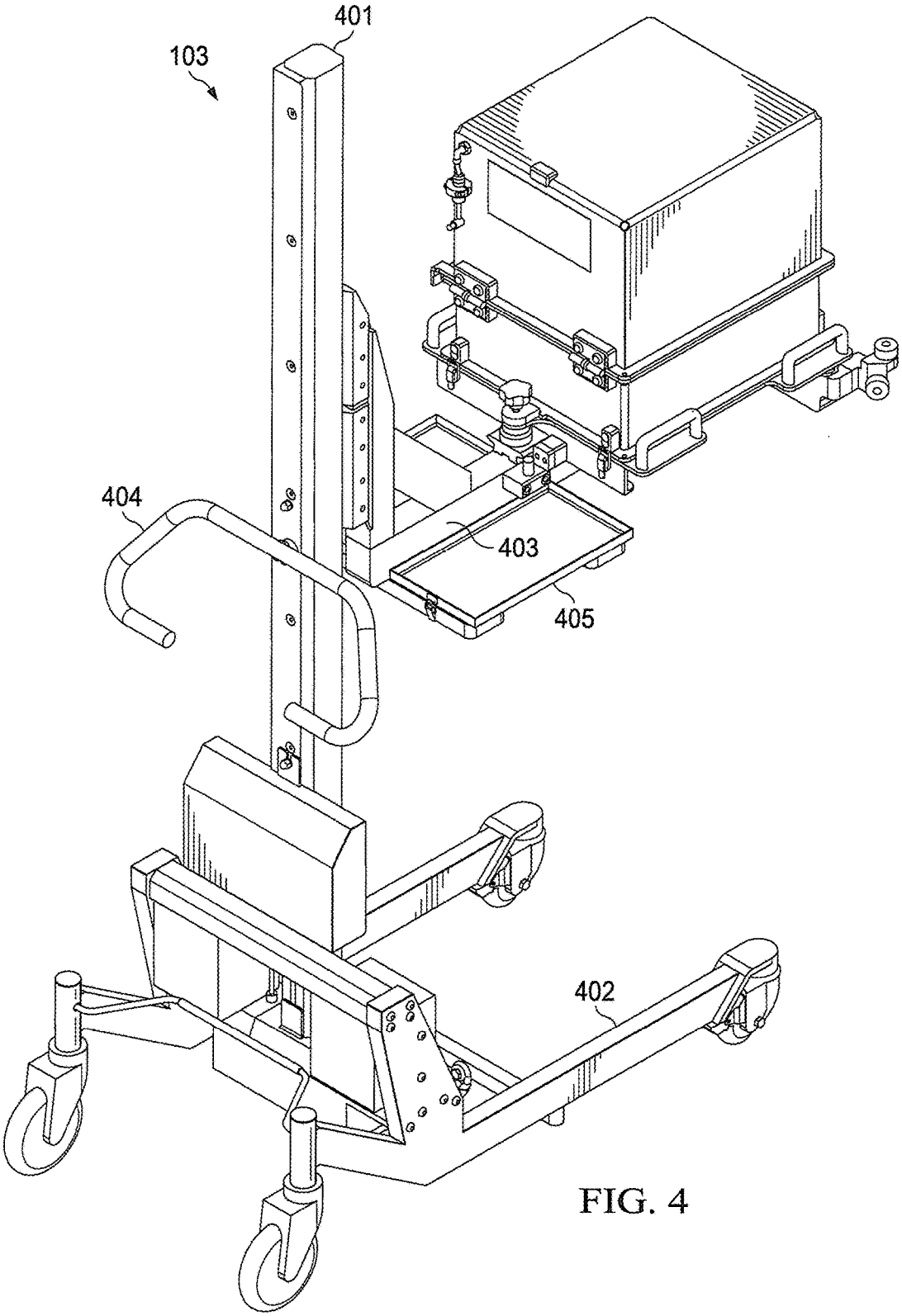
FIG. 4 is a perspective view of an ultra-clean vertical lift transfer cart with an integrated rail transfer mechanism for use within the ultra-clean transportation and storage system of FIGURE

FIG. 4 is a perspective view of an ultra-clean vertical lift transfer cart with an integrated rail transfer mechanism for use within the ultra-clean transportation and storage system of FIG. 1. The ultra-clean vertical lift transfer cart 103 includes a vertical support 401 mounted on a wheeled base 402 arranged to support heavy loads forward of the vertical support 401. That is, the legs of wheeled base 402 extend further forward of vertical support 401 so that the ultra-clean vertical lift transfer cart 103 is less likely to tip when supporting a load. A lift arm 403 is secured to the vertical support 401 in a manner allowing vertical movement of the lift arm 403 along the vertical support 401 under the control of an operator using an appropriate mechanical or powered (hydraulic or electric) lift mechanism. Handle 404 allows the operator to move the ultra-clean vertical lift transfer cart 103, with the wheeled base 402 permitting ready movement by the operator even when the transfer cart 103 is loaded. Removable tool trays 405 on either side of the lift arm 403 provide a work surface support for tools to facilitate work on a product supported on the base of a storage container while the base is on the lift arm 403 of the ultra-clean vertical lift transfer cart 103.

Figure 4A:
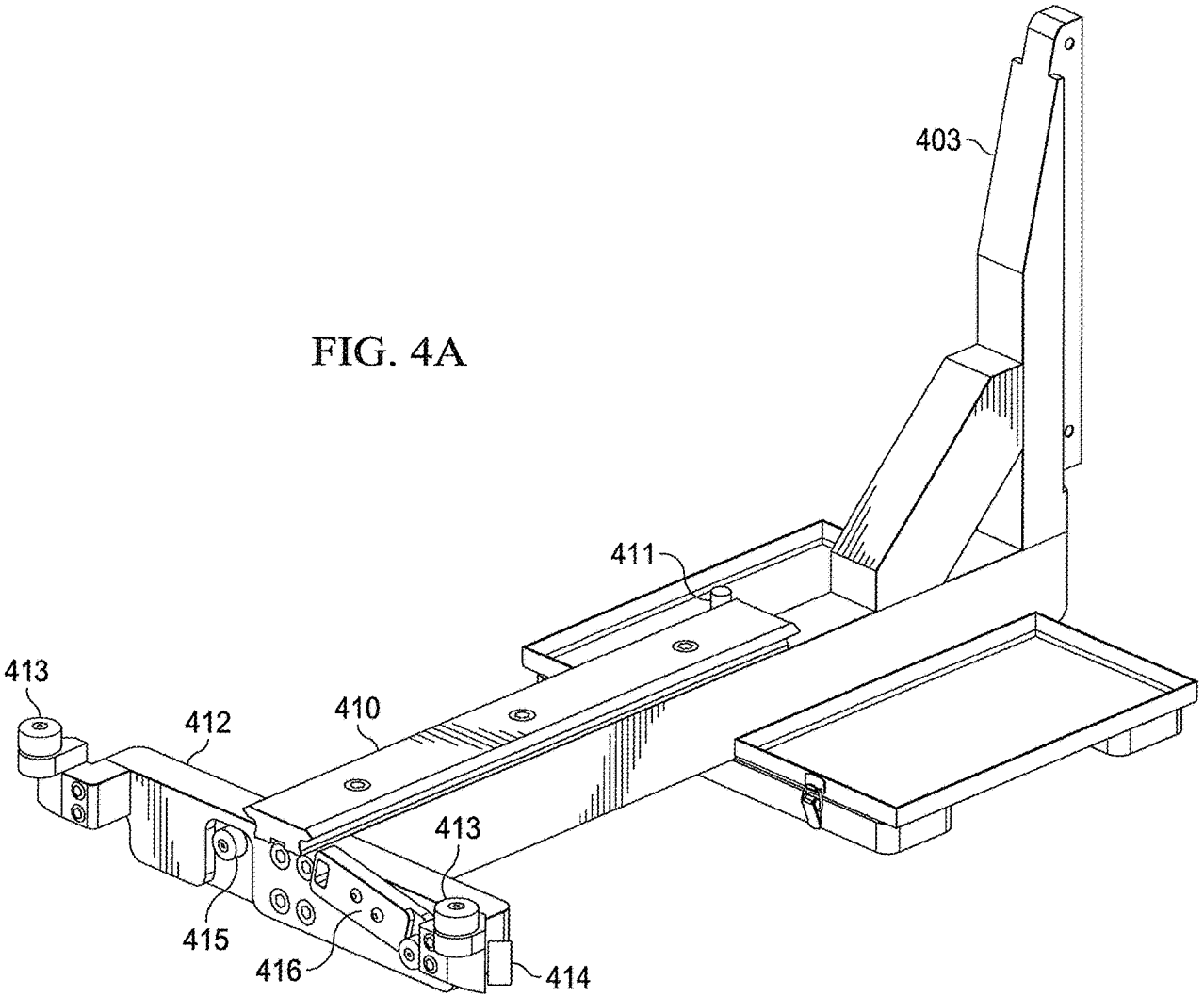
FIG. 4A is a perspective view of the lift arm from the ultra-clean vertical lift transfer cart shown in FIG. 4.
Figure 4B:
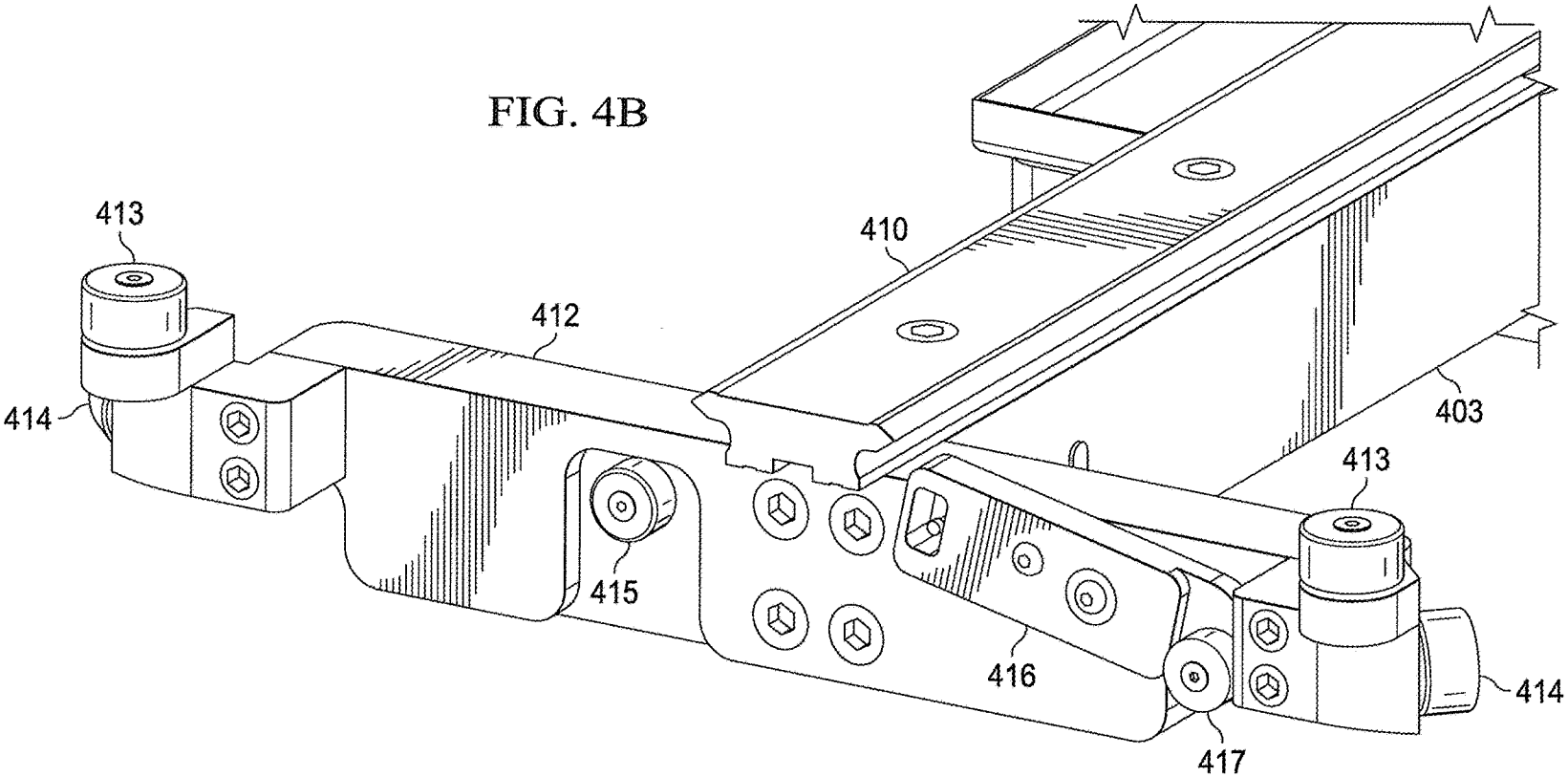
FIG. 4B is a more detailed view of the end effector on that lift arm.

FIG. 4A is a perspective view of the lift arm from the ultra-clean vertical lift transfer cart shown in FIG. 4, and FIG. 4B is a more detailed view of the end effector on that lift arm. The ultra-clean vertical lift transfer cart 103 eliminates any need for manual lifting of the ultra-clean material storage containers 101 and the products held therein. Sliding a container across a flat cart surface will generate particles of a sufficient size to be problematic in production of the sensors of interest. The ultra-clean transportation and storage system of the present disclosure therefore uses a rail system reducing particulate generation over sliding. A rail 410 mounted on top of the lift arm 403 has (as best seen in FIG. 4B) a generally T-shaped cross-section with beveled ends on the horizontal cross-piece. The beveled ends are received in the grooved sidewalls of the rollers 242 mounted on the bottom surface of the ultra-clean material storage container 101. An end-of-rail travel safety limit 411 engages the surface of stop 206 or 236 on the base of the ultra-clean material storage container 101 to limit movement along the rail 410 toward the vertical support 401. The ultra-clean material storage container 101 is thus supported on the horizontal cross-piece for the rail 410 by the rollers 242, which roll along the ends of the horizontal cross-piece as the ultra-clean material storage container 101 is moved onto or off of the rail 410. Fewer particles are generated by the rolling movement of the rollers 242 along the rail 410 than by sliding a container over a flat cart surface. As described below, similar rails are employed on the storage rack and pass-throughs within the ultra-clean transportation and storage system of the present disclosure. The integrated cleanroom rail system thus enables clean transfer of ultra-clean material storage containers 101 from ultra-clean vertical lift transfer cart 103 to other pieces of equipment.

The ultra-clean vertical lift transfer cart 103 includes a transfer end effector at the end of the lift arm, to provide docking and horizontal and vertical alignment mechanisms. The transfer end effector includes a cross-piece 412 at the end of the transfer arm 403 and below the outermost end of the rail 410. Horizontal bushings or rollers 413 are mounted above the cross-piece 412 near the ends, projecting forward from the front face of the cross-piece (which faces the same direction as the outermost end of the rail 410) and spaced to fit between uprights of the storage rack as described further below. Vertical bushings or rollers 414 are mounted on the ends of the cross-piece 412, extending further from the center of cross-piece 412 than horizontal bushings or rollers 413 and, in the example shown, angled relative to the front face of the cross-piece 412. The vertical bushings or rollers 414 function as safety stops and are received by vertical safety stop catches on the uprights of the storage rack as described further below.

Mounted on the front face of the cross-piece 412 are a roller 415, mounted within a recess in the front fact of the cross-piece 412 in the example shown, and a spring-loaded movable gate 416 including a roller 417. The roller 415 and the roller 417 on the spring-loaded movable gate 416 engage counterpart catches on the storage rack or pass-through during vertical alignment of the rail 410 on the ultra-clean vertical lift transfer cart 103 with a corresponding rail on the storage rack or pass-through, as described in further detail below. The docking and alignment mechanisms provided by the transfer end effector on the lift arm of the ultra-clean vertical lift transfer cart 103 allows ultra-clean vertical lift transfer cart 103 to align horizontally and vertically with respect to another piece of equipment (such as the storage rack or pass-through) and enables clean interface between the ultra-clean vertical lift transfer cart 103 and such other equipment. The rolling motion of the rollers 413 and 414 employs sealed bearings, and the rollers 416 and 417 and end-of-rail safety stops contribute to integrated error-proofing.

Figure 5:
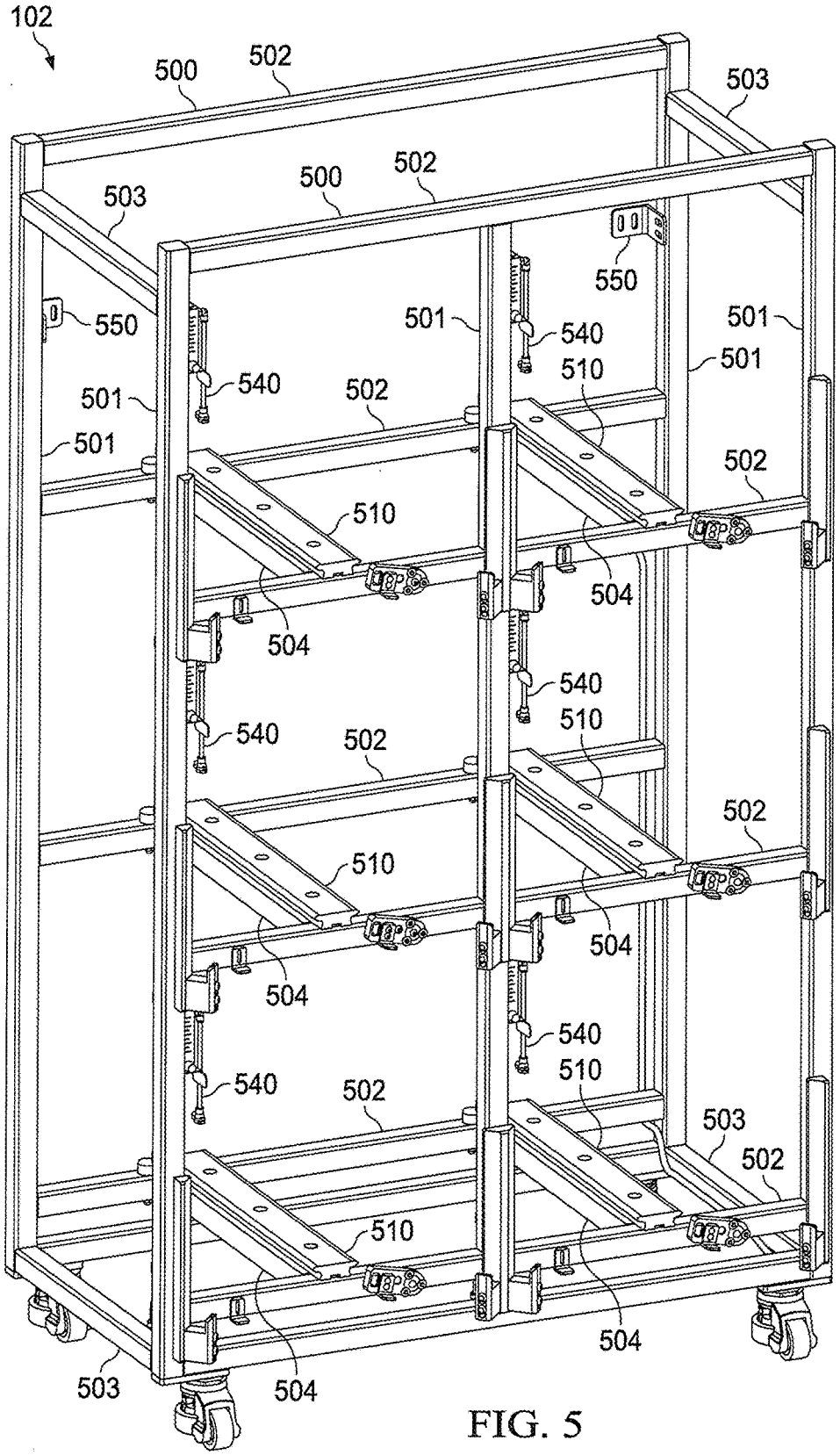
FIG. 5 is a perspective view of an ultra-clean material storage rack with an integrated rail transfer mechanism for use within the ultra-clean transportation and storage system of FIG. 1.

FIG. 5 is a perspective view of an ultra-clean material storage rack with an integrated rail transfer mechanism for use within the ultra-clean transportation and storage system of FIG. 1. The ultra-clean material storage rack 102 is formed by front and rear frames 500 each formed by vertical uprights 501 and horizontal beams 502. The front and rear frames 500 are held in position relative to each other by spars 503 at the corners of the frames 500 and by rail supports 504 at the bottom center of each storage space defined by the ultra-clean material storage rack 102. Each storage space within the ultra-clean material storage rack 102 is defined by the space between adjacent pairs of vertical uprights 501 on the front frame 500 and between adjacent pairs of horizontal beams 503 and above rail supports 504. In the example shown, the ultra-clean material storage rack 102 is configured to support six instances of the ultra-clean material storage container 101 and the products contained therein. The ultra-clean material storage rack 102 may be mounted on wheels for ease of movement and may include brackets 550 for securing the ultra-clean material storage rack 102 to a building wall to reduce the likelihood of tipping, as shown in the example of FIG. 5.

Proximate to each storage space on the ultra-clean material storage rack 102 is a gas (e.g., nitrogen) line connection 540 for connection with the inlet 240 on the ultra-clean material storage container 101. Selective control of gas to each of the gas line connections 540 provides a modular purge capability allowing an operator to purge as many or as few containers on the ultra-clean material storage rack 102 as desired and/or at various independent flow rates. The provision of gas line connections 540 with individual control of gas to those connections eliminates the need to expose hardware within each ultra-clean material storage container 101 to outside environment or additional hardware while in storage on the ultra-clean material storage rack 102.

The ultra-clean material storage rack 102 includes an integrated cleanroom rail system including a rail within each storage space and an integrated docking mechanism on the front face of the front frame 500. Each of the rails 510 has the same size and cross-sectional shape and the same general length as the rail 410 on the ultra-clean vertical lift transfer cart 103, and operates to support an ultra-clean material storage container 101 in the same manner described above for rail 410. An end-of-rail travel safety limit (not shown) on the rear frame 500 engages the surface of stop 206 or 236 on the base of the ultra-clean material storage container 101 to limit movement along the rail 510 within the storage space. Once moved into a storage space within the ultra-clean material storage rack 102, the friction brake 208 on the ultra-clean material storage container 101 secures the ultra-clean material storage container 101 in position on the respective rail 510, preventing inadvertent movement.

Figure 5A:
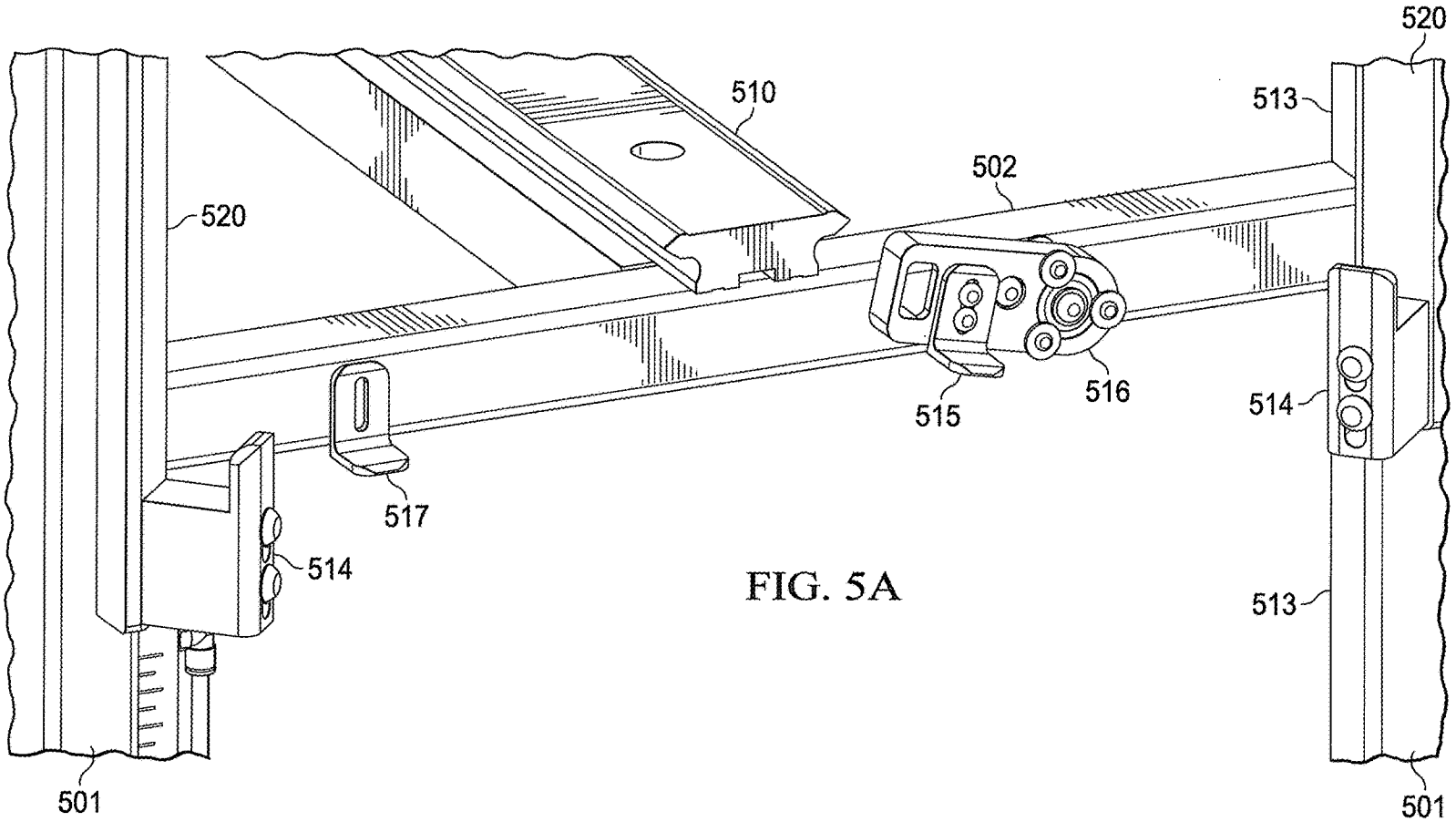
FIG. 5A shows further details of the ultra-clean material storage rack of FIG. 5.

FIG. 5A shows further details of the ultra-clean material storage rack of FIG. 5, and is best considered in conjunction with FIG. 4B. The integrated docking mechanism employs the inner faces 513 of the vertical uprights 501 adjacent to a storage space to ensure lateral horizontal alignment during docking, by rolling of the horizontal bushings or rollers 413 on the ultra-clean vertical lift transfer cart 103 along those inner faces 513 during docking. The integrated docking mechanism also employs the angled corner faces 520 on the vertical uprights 501 adjacent to a storage space to ensure depth-wise horizontal alignment during docking, by rolling of the vertical (safety stop) bushings or rollers 414 on the ultra-clean vertical lift transfer cart 103 along those angle corner faces 520 during docking. The integrated docking mechanism includes pairs of vertical safety stop catches 514 each mounted on the angled corner faces of one of the vertical uprights 501 adjacent to a storage space. The vertical safety stop catches 514 receive the vertical safety stop rollers 414 on the ultra-clean vertical lift transfer cart 103 during docking. Mounted on the front face of the horizontal beam 502 below the rail 510 for the storage space is a fixed stop catch 517 positioned to align vertically with the roller 417 on the spring-loaded movable gate 416 when the ultra-clean vertical lift transfer cart 103 is docking with the ultra-clean material storage rack 102. Also mounted on the front face of the horizontal beam 502 is a spring-loaded movable gate 516 including a gate stop catch 515 positioned to align vertically with the roller 415 on the cross-piece 412 of the ultra-clean vertical lift transfer cart 103 when the ultra-clean vertical lift transfer cart 103 is docking with the ultra-clean material storage rack 102. The spring-loaded movable gates 416 and 516 serve as end-of-travel stops preventing the ultra-clean material storage container 101 from sliding off the respective rail 410 and 510 unless the ultra-clean vertical lift transfer cart 103 is docked with the storage position and the rails 410 and 510 are aligned. During docking, the roller 415 engages bracket 515 to rotate one end of the spring-loaded movable gate 516 downward, out of the path of travel for the ultra-clean material storage container 101. Likewise the roller 417 engages the bracket 517 to rotate the opposite end of the spring-loaded movable gate 416 downward, out of the path of travel for the ultra-clean material storage container 101. Absent such rotation of the spring-loaded movable gate 416 or 516, an end of the spring-loaded movable gate 416 or 516 is positioned along the path of travel of the ultra-clean material storage container 101 and prevents movement of that container off of (or on to) the respective rail 410 or 510.

Figure 6A:
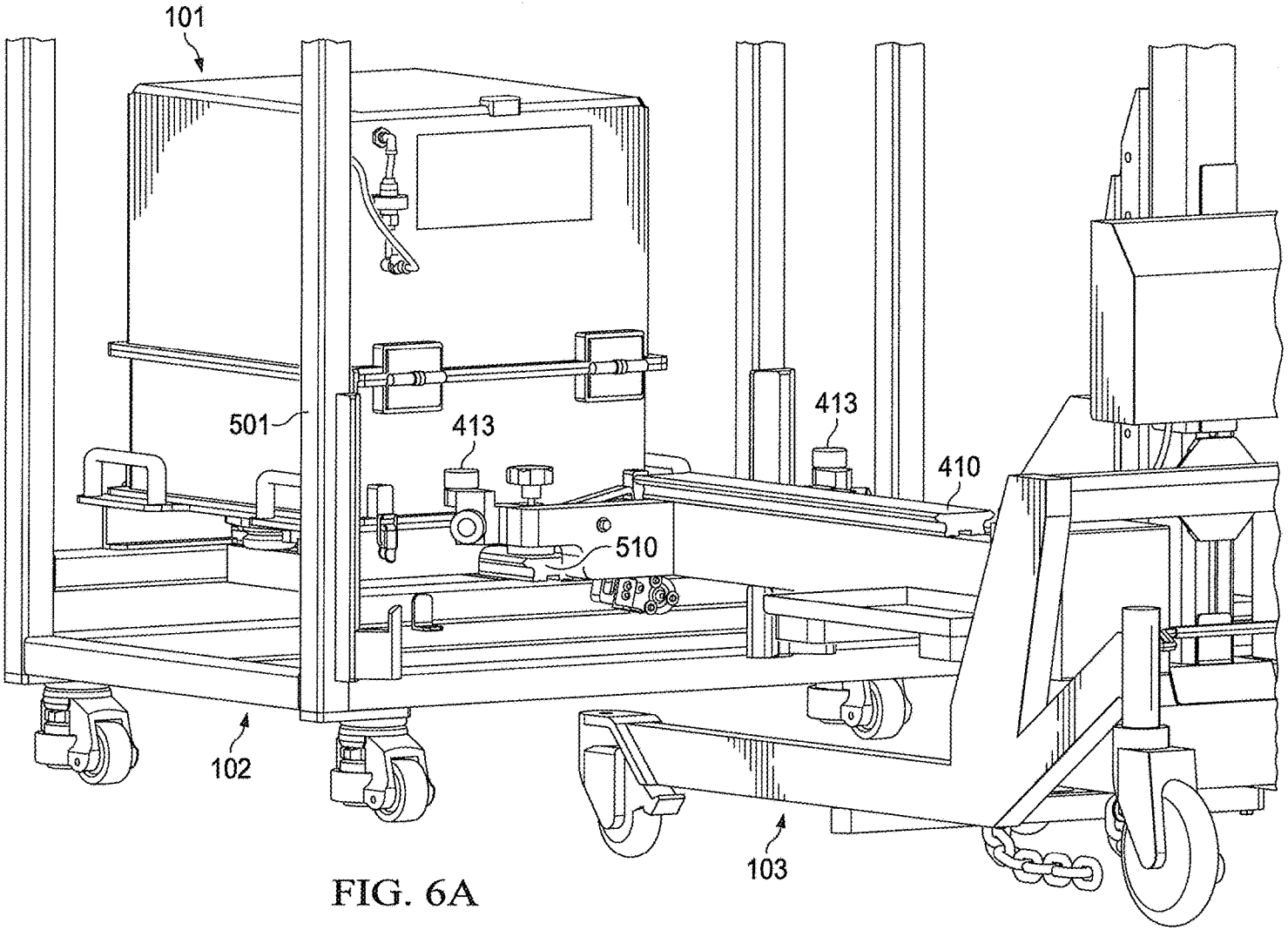
FIGS. 6A to 6E are a series of illustrations showing docking of an ultra-clean vertical lift transfer cart to a storage space in an ultra-clean material storage rack and transfer of an ultra-clean material storage container from the ultra-clean material storage rack onto the ultra-clean vertical lift transfer cart in accordance with embodiments of the present disclosure.

FIGS. 6A to 6E are a series of illustrations showing docking of an ultra-clean vertical lift transfer cart to a storage space in an ultra-clean material storage rack and transfer of an ultra-clean material storage container from the ultra-clean material storage rack onto the ultra-clean vertical lift transfer cart accordance with embodiments of the present disclosure. In FIG. 6A, an ultra-clean material storage container 101 is supported within a storage space of an ultra-clean material storage rack 102. An ultra-clean vertical lift transfer cart 103 is positioned in front of but spaced apart from the storage space of an ultra-clean material storage rack 102 with the rail 410 on ultra-clean vertical lift transfer cart 103 above the rail 510 on the ultra-clean material storage rack 102. The horizontal bushings or rollers 413 on the ultra-clean vertical lift transfer cart 103 are positioned to roll along the inner faces of the vertical uprights 501 adjacent the storage space.

Figure 6B:
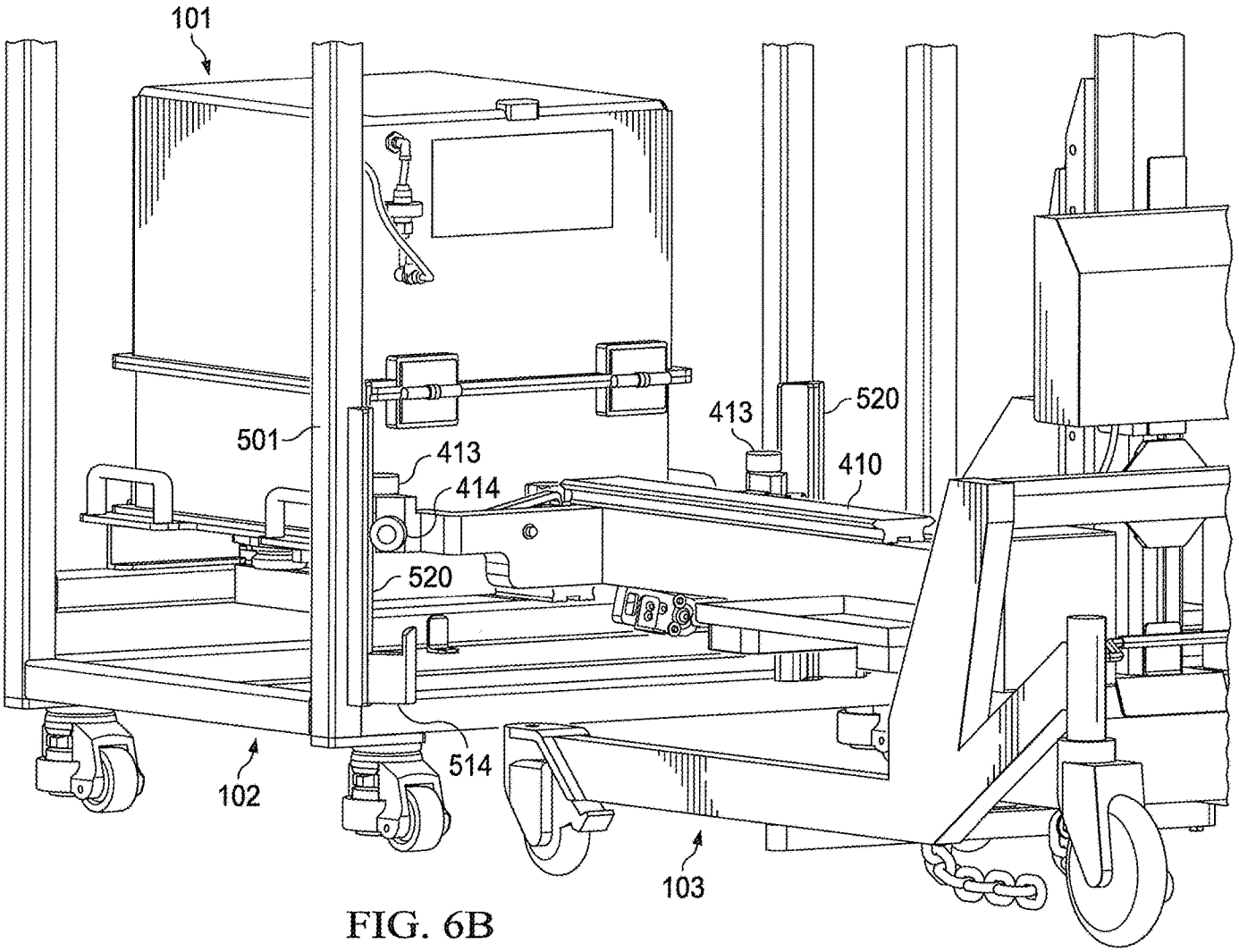

In FIG. 6B, the ultra-clean vertical lift transfer cart 103 has been moved forward toward the ultra-clean material storage rack 102. The horizontal bushings or rollers 413 on the ultra-clean vertical lift transfer cart 103 roll along the inner faces of the vertical uprights 501 adjacent the storage space and guide the ultra-clean vertical lift transfer cart 103 into lateral horizontal alignment with the storage space. The ultra-clean vertical lift transfer cart 103 is moved forward until the vertical bushings or rollers 414 on the ultra-clean vertical lift transfer cart 103 contact the angled corner faces 520 on the vertical uprights 501 adjacent to a storage space, above the vertical safety stop catches 514. The vertical bushings or rollers 414 thus ensure depth-wise horizontal alignment of the ultra-clean vertical lift transfer cart 103 with the storage space and the ultra-clean material storage rack 102.

Figure 6C:
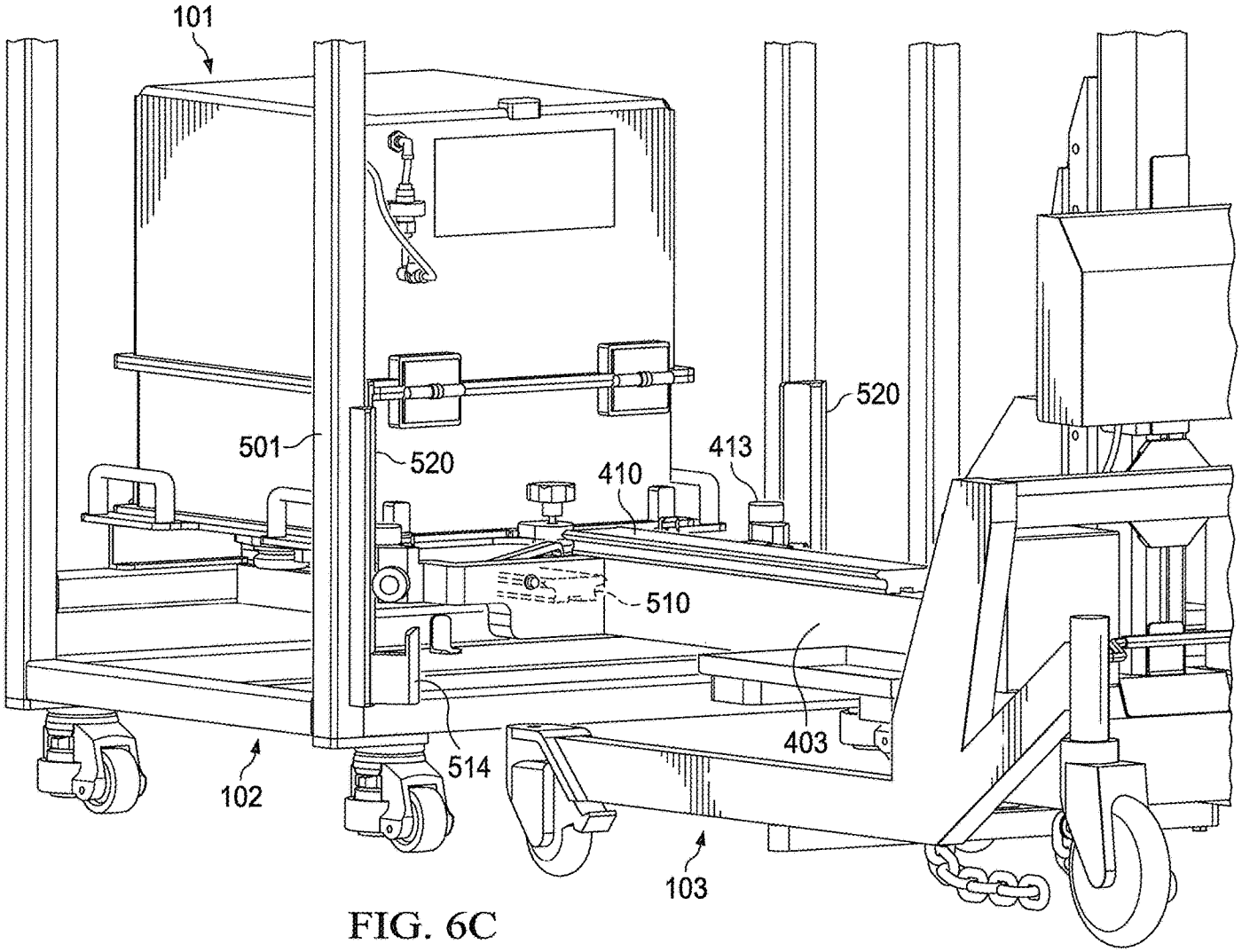

In FIG. 6C, the lift arm 403 on the ultra-clean vertical lift transfer cart 103 is lowered until the horizontal bushings or rollers 413 begin to be received by the vertical safety stop catches 514. The rail 410 on ultra-clean vertical lift transfer cart 103 remains above the rail 510 on the ultra-clean material storage rack 102, but is in lateral and depth-wise horizontal alignment with that rail 510 and is vertically closer to the rail 510. When received by the vertical safety stop catches 514, the horizontal bushings or rollers 413 will inhibit lateral or depth-wise movement of the ultra-clean vertical lift transfer cart 103 relative to the storage space and the ultra-clean material storage rack 102.

Figure 6D:
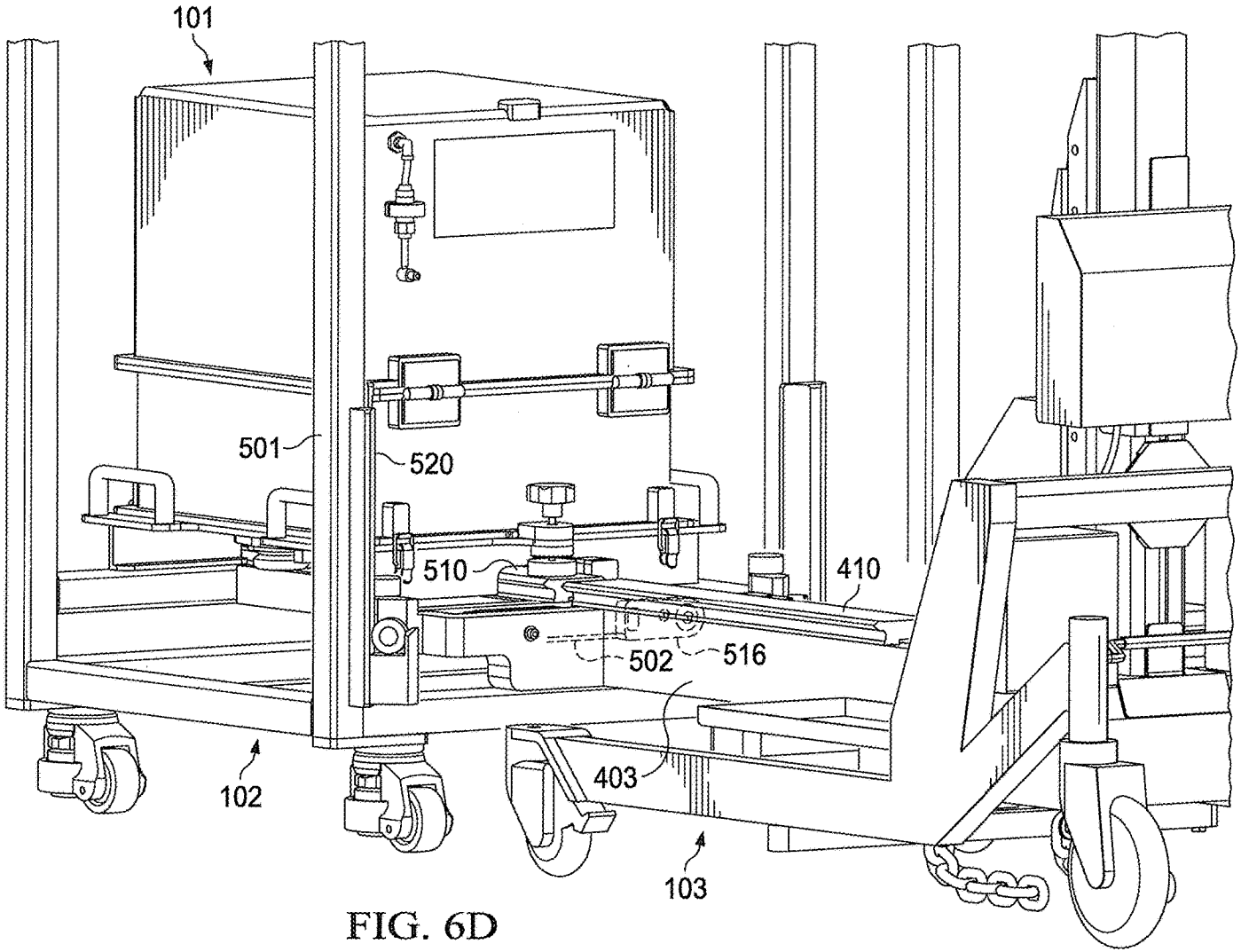

In FIG. 6D, the lift arm 403 on the ultra-clean vertical lift transfer cart 103 is further lowered until the horizontal bushings or rollers are fully received by the vertical safety stop catches. Although not fully visible, the fixed stop catch on the front face of the horizontal beam 502 engages the roller 417 on the spring-loaded movable gate 416 on the ultra-clean vertical lift transfer cart 103, and the roller 415 on the ultra-clean material storage rack 102 engages the gate stop catch 515 on the spring-loaded movable gate 516 on the front face of the horizontal beam 502. The engagement of these elements ensures that the ultra-clean material storage container 101 cannot be transferred until vertical alignment of the rail 410 on ultra-clean vertical lift transfer cart 103 with the rail 510 on the ultra-clean material storage rack 102 is achieved.

Figure 6E:
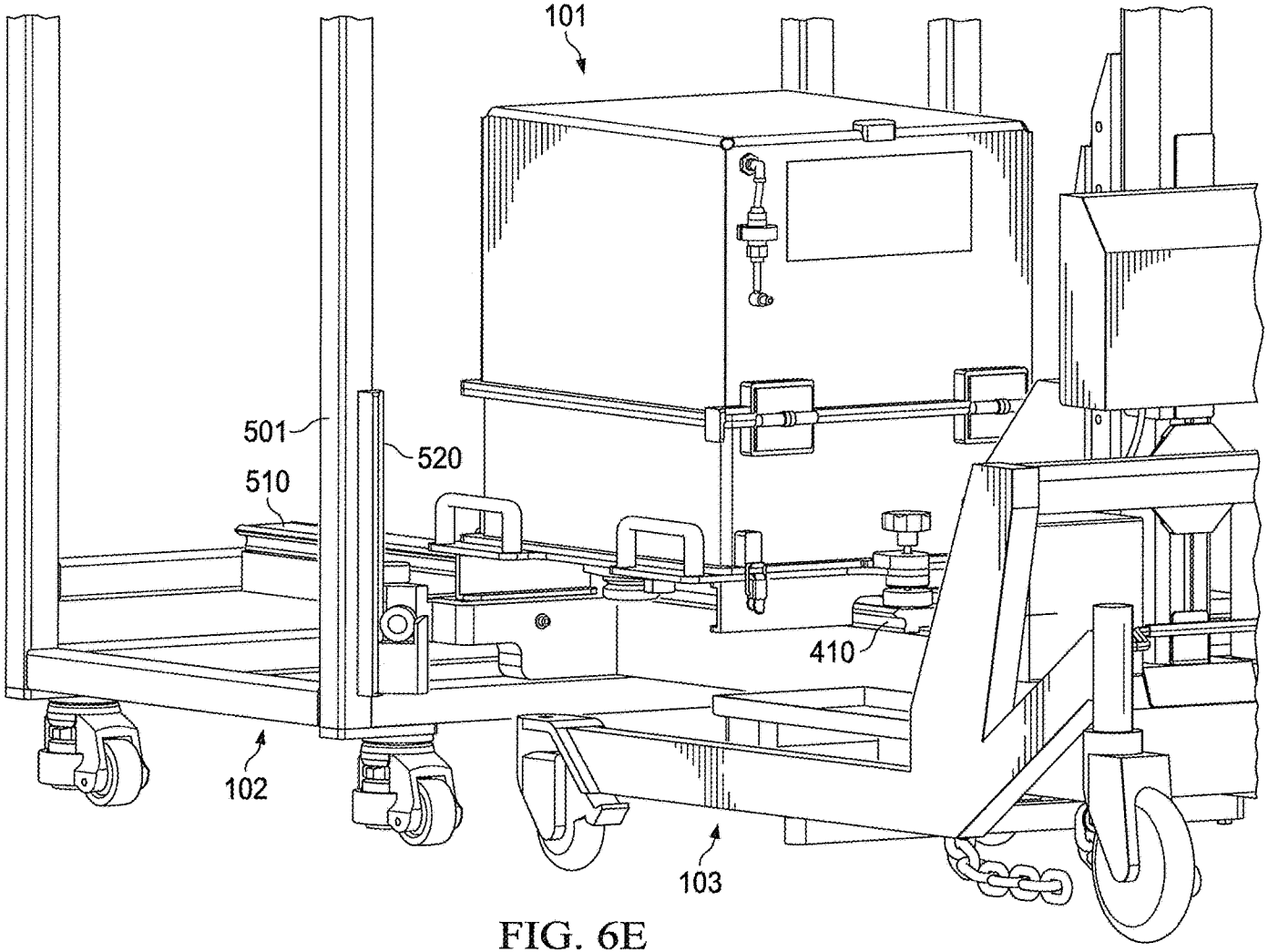

In FIG. 6E, the friction brake on the ultra-clean material storage container 101 has been released, and the ultra-clean material storage container 101 has been rolled along rail 510 on the ultra-clean material storage rack 102 onto and along rail 410 on the ultra-clean vertical lift transfer cart 103. The friction brake may be applied to secure the ultra-clean material storage container 101 in position on the rail 410 of the ultra-clean vertical lift transfer cart 103.

Those skilled in the art will recognize that the process of docking an ultra-clean vertical lift transfer cart 103 to a storage space in an ultra-clean material storage rack 102 and transferring an ultra-clean material storage container 101 from the ultra-clean vertical lift transfer cart 103 onto the ultra-clean material storage rack 102 is substantially similar to the process illustrated in FIGS. 6A-6E, except for the initial location of the ultra-clean material storage container 101 and the direction of movement of that ultra-clean material storage container 101 in FIG. 6E.

Figure 7:
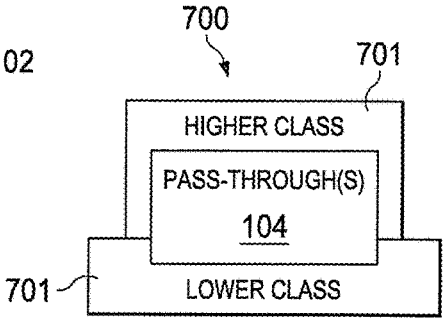
FIG. 7 is a block diagram conceptually illustrating the position of an ultra-clean pass-through with vertical door and integrated rail system for use within the ultra-clean transportation and storage system of FIG. 1.

FIG. 7 is a block diagram conceptually illustrating the position of an ultra-clean pass-through with vertical door and integrated rail system for use within the ultra-clean transportation and storage system of FIG. 1. The ultra-clean pass-through 104 is intended for use in an environment 700 having multiple cleanrooms, to be positioned between cleanrooms of different classes, such as between a higher class (and possibly smaller) cleanroom 701 and a lower class (and possibly larger) cleanroom 702. The ultra-clean pass-through 104 includes a frame that is mounted within a wall between the two cleanrooms 701 and 702, sealed against leaks between the two cleanrooms around edges of the ultra-clean pass-through 104.

Figure 8:
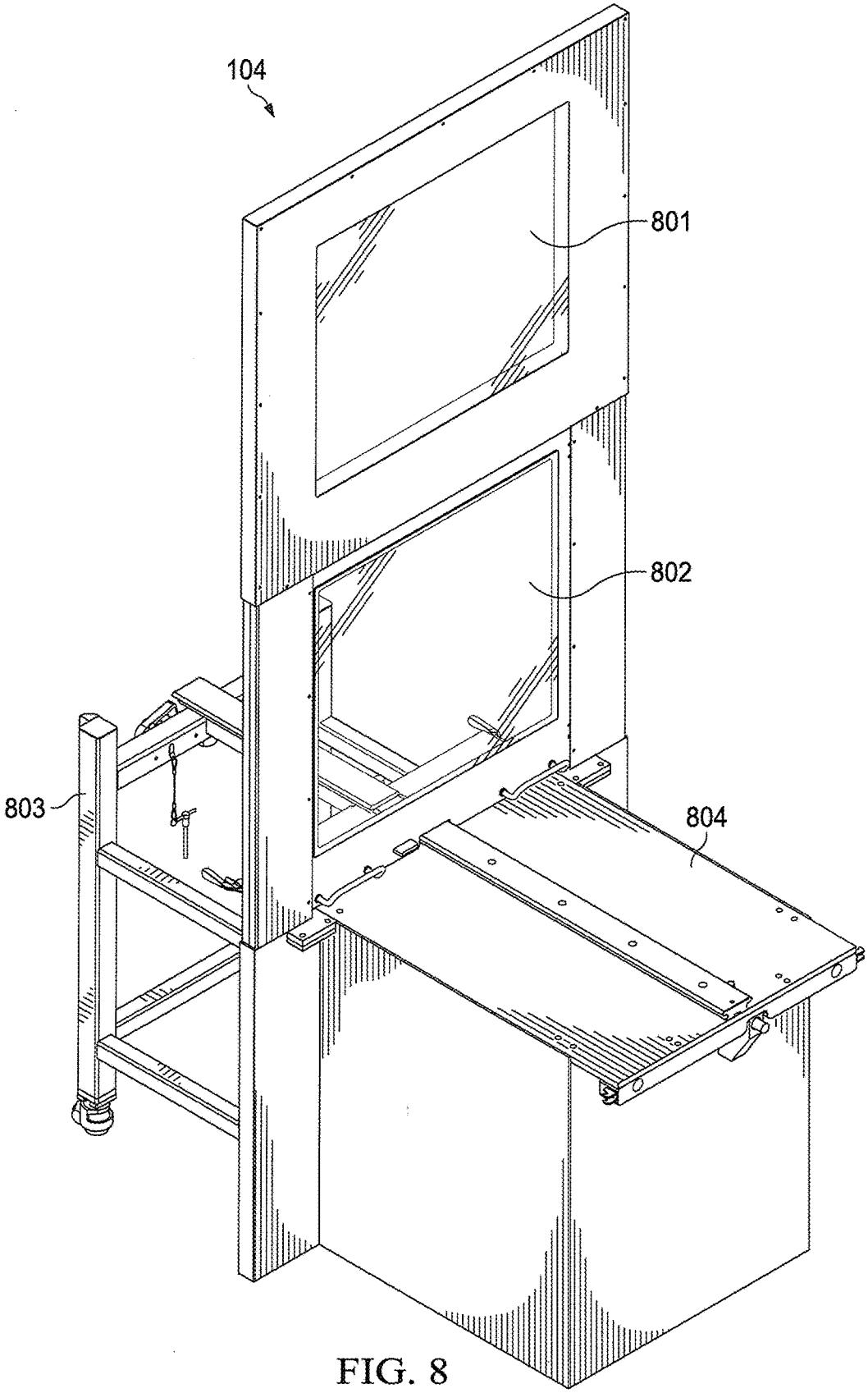
FIG. 8 is a perspective view showing further details of the ultra-clean pass-through of FIG. 1B.

FIG. 8 is a perspective view showing further details of the ultra-clean pass-through of FIG. 1B. The ultra-clean pass-through 104 is intended for use with positive pressure cleanroom designs. The ultra-clean pass-through 104 offset includes a single door formed by upper and lower windows 801 and 802, respectively. The upper window is fixed in position and the lower window 802 "slides" (preferably on rollers or bearings) between a lowered, closed position covering a product storage container transfer opening through the ultra-clean pass-through 104 and an upward, open position in which the lower window 802 substantially overlaps the upper window 801, leaving the product storage container transfer through the ultra-clean pass-through 104 substantially uncovered or unblocked. Fully enclosed counter-balanced door weights ensure that the lower window 802 remains in place when released, whether in the open or closed position. The single door design eliminates the need for two interlocking doors, which is standard for commercial, off-the-shelf (COTS) pass-through designs. Increased visibility is provided due to the additional window 801 above the pass-through opening. Increased load capacity over COTS designs is provided by the support structures adjacent the door 803 and 804.

The ultra-clean pass-through 104 includes the same integrated cleanroom rail system as has been described above. On at least one side (for example, the higher class cleanroom side) of the ultra-clean pass-through 104, a structure 803 essentially forming a portion of the ultra-clean material storage rack 102 described above is used to interface the ultra-clean vertical lift transfer cart 103 with the ultra-clean pass-through 104. The structure 803 may, like the ultra-clean material storage rack 102, be movable in order to be shifted to a storage location when not in use. The same rail design, the same alignment and docking mechanisms, and the same process described above in connection with the ultra-clean material storage rack 102 and docking the ultra-clean vertical lift transfer cart 103 to the ultra-clean material storage rack 102 are employed for the structure 803. The rail path formed simply extends further, through the opening through the ultra-clean pass-through 104 and onto an interface structure 804 on the other side to allow complete movement of an ultra-clean material storage container 101 through the opening of the ultra-clean pass-through 104. The structure 804 may be substantially identical to the structure 803 or, as shown in FIG. 8, may be a simpler structure. In still other embodiments, the alignment and docking mechanisms described above in connection with the ultra-clean material storage rack 102 may be provided on both sides of the ultra-clean pass-through 104, for docking of an ultra-clean vertical lift transfer cart 103 on each side of a product storage container transfer opening through the ultra-clean pass-through 104. Transfer of an ultra-clean material storage container 101 may therefore be achieved from an ultra-clean vertical lift transfer cart 103 on one side of product storage container transfer opening through the ultra-clean pass-through 104 to an ultra-clean vertical lift transfer cart 103 on the other side of that opening. In any of these embodiments with the features described above, the ultra-clean pass-through 104 of FIG. 8 enables safe and clean transfer of material into and out of an area, with integrated error-proofing and increased load capability relative to COTS pass-through designs.

The ultra-clean transportation and storage system of the present disclosure includes integrated error-proofing to ensure hardware safety from damage or contamination when stored or transferred. Docking alignment mechanisms, go/no-go docking safety transfer stops, and over-travel limiting features improve interoperability during movement from a transfer cart to a storage rack (or pass-through) or vice versa. Low particulating, sealed designs that use rolling rather than sliding motion reduce particulate generation. All equipment is designed for cleanliness, with cleanroom and solvent compatible materials, surface finishes, and coatings for enhanced cleanability.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

The description in the present application should not be read as implying that any particular element, step, or function is an essential or critical element which must be included in the claim scope: the scope of patented subject matter is defined only by the allowed claims. Moreover, none of these claims are intended to invoke 35 USC §112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," or "controller" within a claim is understood and intended to refer to structures known to those skilled in the relevant art, as further modified or enhanced by the features of the claims themselves, and is not intended to invoke 35 U.S.C. §112(f).

What is claimed is:

1. A product storage container, comprising:

a base;

product supports mounted on a surface of the base, the product supports configured to support a product on tops of the product supports;

a lower lid segment detachably secured to the base and surrounding portions of the product supports such that the lower lid segment terminates below the tops of the product supports;

an upper lid segment detachably secured to the lower lid segment, the upper lid segment surrounding at least portions of the product supports and extending over the product supports, wherein the base, the lower lid segment, and the upper lid segment form an enclosure around the product supports; and a plurality of rollers mounted in pairs on a bottom surface of the base platform and comprising a rotational axis extending downwardly relative to the bottom surface of the base platform each of the rollers having grooved sidewalls configured to receive and roll along edges of a rail received between the roller pairs, to support the product storage container by contact of the rollers with the rail.

2. The product storage container according to claim 1, wherein the upper lid segment is secured to the lower lid segment at least in part by lift-off hinges configured to allow separation of the upper lid segment from the lower lid segment only after the upper lid segment has been rotated around the lift-off hinges by at least 90° from a closed position.

3. The product storage container according to claim 1, further comprising:

seals within an interface between the lower lid segment and the base and between the upper lid segment and the lower lid segment, the seals configured to seal the enclosure;

a one-way breather valve configured to allow gas to be expelled from the enclosure; and a filtered gas inlet configured to allow gas to be injected into the enclosure, wherein injection of gas into an interior of the enclosure via the gas inlet purges the interior.

4. The product storage container according to claim 1, further comprising:

a friction brake mounted to the base, the friction brake including:

a revolving brake pad having an integrated O-ring contact surface and movable between braking and non-braking positions, the contact surface configured to contact a portion of the rail in the braking position to inhibit movement of the product storage container along the rail, and a housing enclosing complementary acme threads configured to move the brake pad.

5. The product storage container according to claim 4, wherein the portion of the rail contacted by the contact surface is located between the edges of the rail.

6. The product storage container according to claim 1, further comprising:

handles secured to portions of the base extending outside the lower lid segment;

support beams secured to the bottom surface of the base, at least one of the support beams including a rail entry configured to allow the rail to be inserted between the rollers; and at least one stop mounted on one of the support beams and configured to limit movement of the product storage container along the rail.

7. The product storage container according to claim 1, wherein:

the edges of the rail received in the grooved sidewalls of the plurality of rollers extend along ends of a width of the rail; and the rail supports the product storage container from one of a lift arm of a transfer cart, a support on a storage rack, and a transfer support within a pass-through.

8. A product storage container, comprising:

a base platform;

product supports mounted on a top surface of the base platform, the product supports configured to support a product on tops of the product supports;

a lower lid segment detachably secured to the base platform and surrounding lower portions of the product supports such that the lower lid segment terminates below the tops of the product supports;

an upper lid segment detachably secured to the lower lid segment, the upper lid segment surrounding at least upper portions of the product supports and extending over the product supports, wherein the base platform, the lower lid segment, and the upper lid segment form an enclosure around the product supports; and a plurality of rollers mounted in pairs on a bottom surface of the base platform and comprising a rotational axis extending downwardly relative to the bottom surface of the base platform, each of the rollers having grooved sidewalls configured to receive and roll along ends of a rail received between the roller pairs, to support the product storage container by contact of the rollers with the rail.

9. The product storage container according to claim 8, wherein the upper lid segment is secured to the lower lid segment at least in part by lift-off hinges configured to allow separation of the upper lid segment from the lower lid segment only after the upper lid segment has been rotated around the lift-off hinges by at least 90° from a closed position.

10. The product storage container according to claim 8, further comprising:

seals within an interface between the lower lid segment and the base platform and between the upper lid segment and the lower lid segment, the seals configured to seal the enclosure;

a one-way breather valve configured to allow gas to be expelled from the enclosure; and a filtered gas inlet configured to allow gas to be injected into the enclosure, wherein injection of gas into an interior of the enclosure via the gas inlet purges the interior.

11. The product storage container according to claim 8, further comprising:

a friction brake mounted to the base platform, the friction brake including:

a revolving brake pad having an integrated O-ring contact surface and movable between braking and non-braking positions, the contact surface configured to contact a portion of the rail in the braking position to inhibit movement of the product storage container along the rail, and a housing enclosing complementary acme threads configured to move the brake pad.

12. The product storage container according to claim 11, wherein the portion of the rail contacted by the contact surface is located between edges of a length dimension of the rail.

13. The product storage container according to claim 8, further comprising:

handles secured to portions of the base platform extending outside the lower lid segment;

support beams secured to the bottom surface of the base platform, at least one of the support beams including a rail entry configured to allow the rail to be inserted between the rollers; and at least one stop mounted on one of the support beams and configured to limit movement of the product storage container along the rail.

14. The product storage container according to claim 8, wherein:

the ends of the rail received in the grooved sidewalls of the plurality of rollers extend along edges of a length dimension of the rail; and the rail supports the product storage container from one of a lift arm of a transfer cart, a support on a storage rack, and a transfer support within a pass-through.

15. A product storage container, comprising:

a base;

product supports extending upwardly from an upper surface of the base, the product supports configured to support a product on tops of the product supports;

a lower lid segment detachably secured to the base and surrounding lower portions of the product supports such that the lower lid segment terminates below the tops of the product supports;

an upper lid segment detachably secured to the lower lid segment, the upper lid segment surrounding at least portions of the product supports and extending over the product supports, wherein the base, the lower lid segment, and the upper lid segment form an enclosure around the product supports; and a plurality of rollers mounted in pairs on a bottom surface of the base and comprising a rotational axis extending downwardly relative to the bottom surface of the base, the rollers having grooved sidewalls configured to receive and roll along edges of a rail received between the roller pairs, to support the product storage container by contact of the rollers with the rail to support the product storage container from one of a lift arm of a transfer cart, a product container support on a storage rack, and a product container support within a pass-through.

16. The product storage container according to claim 15, wherein the upper lid segment is secured to the lower lid segment at least in part by lift-off hinges configured to allow separation of the upper lid segment from the lower lid segment only after the upper lid segment has been rotated around the lift-off hinges by at least 90° from a closed position.

17. The product storage container according to claim 15, further comprising:

seals within an interface between the lower lid segment and the base and between the upper lid segment and the lower lid segment, the seals configured to seal the enclosure;

a one-way breather valve configured to allow gas to be expelled from the enclosure; and a filtered gas inlet configured to allow gas to be injected into the enclosure, wherein injection of gas into an interior of the enclosure via the gas inlet purges the interior.

18. The product storage container according to claim 15, further comprising:

a friction brake mounted to the base, the friction brake including:

a revolving brake pad having an integrated O-ring contact surface and movable between braking and non-braking positions, the contact surface configured to contact a portion of the rail in the braking position to inhibit movement of the product storage container along the rail, and a housing enclosing complementary acme threads configured to move the brake pad.

19. The product storage container according to claim 18, wherein:

the edges of the rail received in the grooved sidewalls of the plurality of rollers extend along ends of a width of the rail; and the portion of the rail contacted by the contact surface is located between the edges of the rail.

20. The product storage container according to claim 15, further comprising:

handles secured to portions of the base extending outside the lower lid segment;

support beams secured to the bottom surface of the base, at least one of the support beams including a rail entry configured to allow the rail to be inserted between the rollers; and at least one stop mounted on one of the support beams and configured to limit movement of the product storage container along the rail.

* * * * *